US008752923B2

(12) United States Patent
Kobayashi

(10) Patent No.: US 8,752,923 B2
(45) Date of Patent: Jun. 17, 2014

(54) IMAGE FORMING APPARATUS

(75) Inventor: Takeyuki Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 98 days.

(21) Appl. No.: 13/577,834

(22) PCT Filed: Mar. 3, 2011

(86) PCT No.: PCT/JP2011/055565
§ 371 (c)(1),
(2), (4) Date: Aug. 8, 2012

(87) PCT Pub. No.: WO2011/111759
PCT Pub. Date: Sep. 15, 2011

(65) Prior Publication Data

US 2013/0044148 A1 Feb. 21, 2013

(30) Foreign Application Priority Data

Mar. 12, 2010 (JP) ..... 2010-056534

(51) Int. Cl.
*B41J 29/38* (2006.01)
*B41J 2/175* (2006.01)

(52) U.S. Cl.
CPC ..... *B41J 2/17509* (2013.01); *B41J 2/17566* (2013.01); *B41J 2/17556* (2013.01); *B41J 2002/17586* (2013.01)
USPC ..... 347/6

(58) Field of Classification Search
CPC combination set(s) only.
See application file for complete search history.

(56) References Cited

U.S. PATENT DOCUMENTS

| | | | | |
|---|---|---|---|---|
| 6,137,503 | A | 10/2000 | Hashimoto et al. | |
| 7,540,598 | B2 | 6/2009 | Hori et al. | |
| 8,177,313 | B2 | 5/2012 | Suzuki et al. | |
| 2007/0040877 | A1 | 2/2007 | Kachi | |
| 2008/0079790 | A1 | 4/2008 | Kachi | |
| 2009/0122093 | A1* | 5/2009 | Mutoh | 347/7 |
| 2009/0122122 | A1 | 5/2009 | Kubo et al. | |
| 2010/0026742 | A1* | 2/2010 | Morino | 347/7 |

FOREIGN PATENT DOCUMENTS

| | | |
|---|---|---|
| EP | 0626267 A2 | 11/1994 |
| JP | 2001-162834 | 6/2001 |
| JP | 3219326 | 8/2001 |

(Continued)

OTHER PUBLICATIONS

Euroean search report dated Jul. 26, 2013 in connection with corresponding European patent application No. 11 75 37417.2.

(Continued)

*Primary Examiner* — Shelby Fidler
*Assistant Examiner* — Tracey McMillion
(74) *Attorney, Agent, or Firm* — Cooper & Dunham LLP

(57) ABSTRACT

A disclosed image forming apparatus includes an apparatus main body, a recording head, a sub tank, a carriage, a main tank, and a fluid feeding unit supplying fluid from the main tank to the sub tank, in which the sub tank includes a displacement member displaced depending on a remaining amount, the carriage includes a first detecting unit detecting the displacement member, the apparatus main body includes a second detecting unit detecting the displacement member, the image forming apparatus detects and stores a differential supply amount corresponding to a displacement amount of the displacement member between positions detected by the first detecting unit and the second detecting unit, respectively, and the differential supply amount of liquid is supplied to the sub tank after the first detecting unit detects the displacement member when liquid is supplied without using the second detecting unit.

11 Claims, 19 Drawing Sheets

(56) References Cited

FOREIGN PATENT DOCUMENTS

| | | |
|---|---|---|
| JP | 2007-15153 | 1/2007 |
| JP | 2007-130979 | 5/2007 |
| JP | 2007-136807 | 6/2007 |
| JP | 2008-132638 | 6/2008 |
| JP | 4155879 | 9/2008 |
| JP | 2008-265125 | 11/2008 |
| JP | 4190001 | 12/2008 |
| JP | 2009-23092 | 2/2009 |
| JP | 2009-23329 | 2/2009 |
| JP | 2009-126049 | 6/2009 |
| JP | 4298474 | 7/2009 |
| JP | 2009-274325 | 11/2009 |

OTHER PUBLICATIONS

International Search Report in PCT/JP2011/055565.

Written Opinion of the International Searching Authority in PCT/JP2011/055565.

* cited by examiner

IMAGE FORMING APPARATUS

TECHNICAL FIELD

The present invention relates to an image forming apparatus, and more particularly to an image forming apparatus having a recording head discharging liquid droplets and a sub tank supplying a fluid to the recording head.

BACKGROUND ART

As an image forming apparatus such as a printer, a facsimile machine, a copier, a plotter, a multi function peripheral thereof and the like, there has been known an inkjet recording apparatus and the like employing a liquid discharging recording method using a recording head discharging ink droplets or the like. In the image forming apparatus employing the liquid discharging recording method, an image is formed by discharging ink droplets from a recording head onto a fed sheet. Herein, the term "forming" is a synonym of the terms recording, typing, imaging, and printing. Further, herein, the term "sheet" is not limited to paper, and refers to any appropriate medium (e.g., the OHP) to which ink droplets, other liquid and the like may be adhered. The image forming apparatus employing the liquid discharging recording method may be classified into two types: a serial-type image forming apparatus and a line-type image forming apparatus. In the serial-type image forming apparatus, an image is formed by discharging ink droplets from the recording head while the recording head moves in the main scanning direction. On the other hand, in the line-type image forming apparatus, an image is formed by discharging ink droplets from the line-type recording head while the recording head does not change its position.

Further, in an embodiment of the present invention, the term "image forming apparatus" employing the liquid discharging recording method refers to an apparatus forming an image by discharging a liquid onto a medium including paper, thread, fiber, textile, leather, metal, plastic, glass, wood, ceramics and the like. Further, the term "image forming" refers to not only forming a meaningful image such as characters, figures, and the like on a medium but also forming a meaningless image such as a pattern and the like on a medium (including simply discharging droplets onto a medium). Further, the term "ink" is collectively used and herein refers to not only any material called "ink" but also any liquid for forming an image which may be called recording liquid, fixing processing liquid, liquid, a DNA sample, a patterning material, a resin and the like. Further, the "image" is not limited to a planar image. For example, the "image" includes an image formed on a material that is three-dimensionally formed and an image three-dimensionally formed made of three-dimensional figures.

Among such image forming apparatuses there is a known image forming apparatus employing an ink supply method in which ink is supplied from a main tank to a sub tank, the main tank (a.k.a. an ink cartridge) being detachably mounted on a main body of the apparatus, the sub tank (also called a head tank or a buffer tank) supplying ink to the recording head.

Among such image forming apparatuses there is a known image forming apparatus having the sub tank (also called a head tank or a buffer tank) supplying ink to the recording head, the sub tank having a negative pressure forming function (mechanism) for generating a negative pressure to prevent a leakage (ooze) or drop of ink from the recording head. The sub tank includes a negative pressure forming unit including a flexible member (film member) forming one surface of the ink container containing ink and an elastic member biasing the flexible member toward outside. The sub tank further includes an air opening mechanism for opening (releasing) the inside of the ink container to the atmosphere, so that ink can be supplied from the ink container to the recording head.

Further, the sub tank further includes a displacement member (which may also be called a detection member or a detection filler) that is displaced in accordance with the displacement of the flexible member. During air opening filling where the sub tank is opened to the atmosphere using the air opening mechanism and ink is supplied from the main tank to the sub tank, the carriage is moved to a predetermined detecting position (full tank filling position). To that end, after the sub tank is air-opened by driving a driving unit provided on the main body side for driving the air opening mechanism, the carriage is moved to the predetermined position, and the ink supply is performed. When the detecting unit on the main body side detects the displacement member, the full tank filling position is determined (Patent Documents 1 through 9).

In this case, to make it possible to supply ink during printing, when ink consumption during printing is equal to or greater than a first predetermined value, based on the information in correlation with the ink supply amount supplied from the main tank to the sub tank during the printing, if the ink supply amount is equal to or less than a second predetermined value, ink is supplied from the main tank to the sub tank, and if the ink supply amount is greater than a second predetermined value, ink is not supplied from the main tank to the sub tank (Patent Document 9).

In another example, the sub tank does not have the structure as described above. Instead, the sub tank includes remaining ink amount detection unit so as to supply ink even during printing (Patent Document 10).

[Patent Document 1] Japanese Patent No. 4298474
[Patent Document 2] Japanese Patent No. 4190001
[Patent Document 3] Japanese Patent No. 4155879
[Patent Document 4] Japanese Laid-Open Patent Application No. 2007-015153
[Patent Document 5] Japanese Laid-Open Patent Application No. 2007-130979
[Patent Document 6] Japanese Laid-Open Patent Application No. 2008-132638
[Patent Document 7] Japanese Laid-Open Patent Application No. 2009-023329
[Patent Document 8] Japanese Laid-Open Patent Application No. 2009-274325
[Patent Document 9] Japanese Laid-Open Patent Application No. 2009-023092
[Patent Document 10] Japanese Patent No. 3219326

DISCLOSURE OF THE INVENTION

Problems to be Solved by the Invention

As described above, in a case where the displacement member displaced based on the remaining ink amount in the sub tank is provided and the apparatus main body side detects the full tank condition of the sub tank, it is necessary to move the carriage to a predetermined filling full tank position. Therefore, when the remaining ink amount in the sub tank is reduced during printing, it is necessary to stop printing operation to perform the ink supply operation. As a result, the printing speed may be reduced.

In this case, it may be possible to calculate the ink consumption amount in the sub tank by counting the number of the discharged droplets so that ink is supplied from the main tank at a supply amount corresponding to the ink consumption amount. In this case, however, the filling full tank position may not be accurately detected. As a result, an excessive negative pressure or insufficient negative pressure may be caused by the supply shortage or the excessive supply, respectively. To avoid those cases, inevitably, it is necessary to move the carriage to the filling full tank detecting position and to perform the air opening filling. As a result, it may be still necessary to stop the printing operation, thereby reducing the printing speed.

Further, there may be an idea that the carriage includes a member or a unit necessary for controlling the ink supply to the sub tank by providing a detecting unit on the carriage side to detect the remaining ink amount of the sub tank. However, when such a mechanism is employed, the weight of the carriage may be increased or the size of the carriage may be enlarged, thereby enlarging the apparatus.

The present invention is made in light of the above problems and may enable to perform full tank filling to the sub tank during printing even when the full tank detection is performed by detecting the displacement member that is displaced in accordance with the remaining amount of the sub tank using the detecting unit provided on the apparatus main body side.

Means for Solving the Problems

In order to solve the above-described problems, an image forming apparatus according to an aspect of the present invention includes:

an apparatus main body;

a recording head discharging liquid droplets;

a sub tank containing liquid to be supplied to the recording head;

a carriage on which the recording head and the sub tank are mounted;

a main tank containing liquid to be supplied to the sub tank; and a fluid feeding unit performing fluid supply from the main tank to the sub tank, wherein the sub tank includes a displacement member to be displaced depending on a remaining amount in the sub tank, the carriage includes a first detecting unit detecting that the displacement member is at a predetermined first position, the apparatus main body includes a second detecting unit detecting that the displacement member is at a predetermined second position, the remaining amount at the predetermined first position is less than the remaining amount at the predetermined second position, the image forming apparatus further includes a control section that detects and stores a differential supply amount corresponding to a displacement amount of the displacement member, the displacement amount corresponding to a difference between a position detected by the first detecting unit and a position detected by the second detecting unit, and the control section performs control to supply the differential supply amount of liquid to the sub tank after the first detecting unit detects the displacement member in a case where liquid is supplied from the main tank to the sub tank without using the second detecting unit.

Herein, the control of the supply of the differential supply amount may be performed based on a driving time period of the fluid feeding unit, the driving time period being required to move the displacement member from the first predetermined position to the second predetermined position.

Further, the control of the supply of the differential supply amount may be performed based on a number of rotations of the fluid feeding unit, the number of rotations being required to move the displacement member from the first predetermined position to the second predetermined position.

Further, the control of the supply of the differential supply amount may be performed based on a detected displacement amount of the displacement member.

Further, the image forming apparatus may further include:

a detecting unit detecting at least one of an environmental temperature and an environmental humidity of the image forming apparatus.

Further, when determining that a difference between a result detected by the detecting unit and a predetermined threshold value is equal to or greater than a predetermined value, the differential supply amount may be detected.

Further, when at least one of the environmental temperature and the environmental humidity is a predetermined value, the predetermined first position may refer to a position where the displacement amount of the displacement member is within a predetermined range, the displacement amount corresponding to a difference between the first predetermined position and the second predetermined position.

Further, a case where liquid is supplied from the main tank to the sub tank without using the second detecting unit may correspond to a case where a discharge amount discharged from the recording head exceeds a predetermined amount.

Further, in a case where the first detecting unit does not detect the displacement member even when a discharge amount discharged from the recording head exceeds a predetermined amount, control may be performed to discharge liquid until the first detecting unit detects the displacement member.

In this case, when a number of times that a control has been performed to discharge liquid until the second detecting unit detects the displacement member exceeds a predetermined number of times, the discharge from the recording head may be stopped.

Further, during scanning of the carriage, while a scanning direction of the carriage corresponds to a direction towards an anterior side of a scanning direction of the displacement member of the sub tank, ink may be supplied to the sub tank.

Further, when the differential supply amount is detected, the displacement member may be displaced by suctioning fluid from the sub tank to the main tank until the first detecting unit detects the displacement member.

Effects of the Present Invention

In an image forming apparatus according to an embodiment of the present invention, the sub tank includes the displacement member to be displaced depending on a remaining amount in the sub tank; the carriage includes a first detecting unit detecting that the displacement member is at a predetermined first position; the apparatus main body includes a second detecting unit detecting that the displacement member is at a predetermined second position; the remaining amount at the predetermined first position is less than the remaining amount at the predetermined second position; the image forming apparatus further includes a control section that detects and stores a differential supply amount corresponding to a displacement amount of the displacement member, the displacement amount corresponding to a difference between a position detected by the first detecting unit and a position detected by the second detecting unit; and the control section performs control to supply the differential supply amount of liquid to the sub tank after the first detecting unit detects the displacement member in a case where liquid is supplied from the main tank to the sub tank without using the second detecting unit. By having the configuration described above, it may become possible to supply an appropriate amount of liquid from the main tank to the sub tank even during the movement of the carriage, thereby enabling improving the printing speed.

DESCRIPTION OF THE REFERENCE NUMERALS

10: INK CARTRIDGE (MAIN TANK)
33: CARRIAGE
34, 34*a*, 34*b*: RECORDING HEAD (LIQUID DISCHARGE HEAD)
35: SUB TANK
81: MAINTENANCE AND RECOVERY MECHANISM
201: TANK CASE (LIQUID CONTAINER)
203: FLEXIBLE MEMBER (FLEXIBLE FILM)
205: DISPLACEMENT MEMBER (FILLER)
251: FIRST SENSOR (FIRST DETECTING UNIT)
301: SECOND SENSOR (SECOND DETECTING UNIT)
500: CONTROL SECTION

BEST MODE FOR CARRYING OUT THE INVENTION

Figure 1:
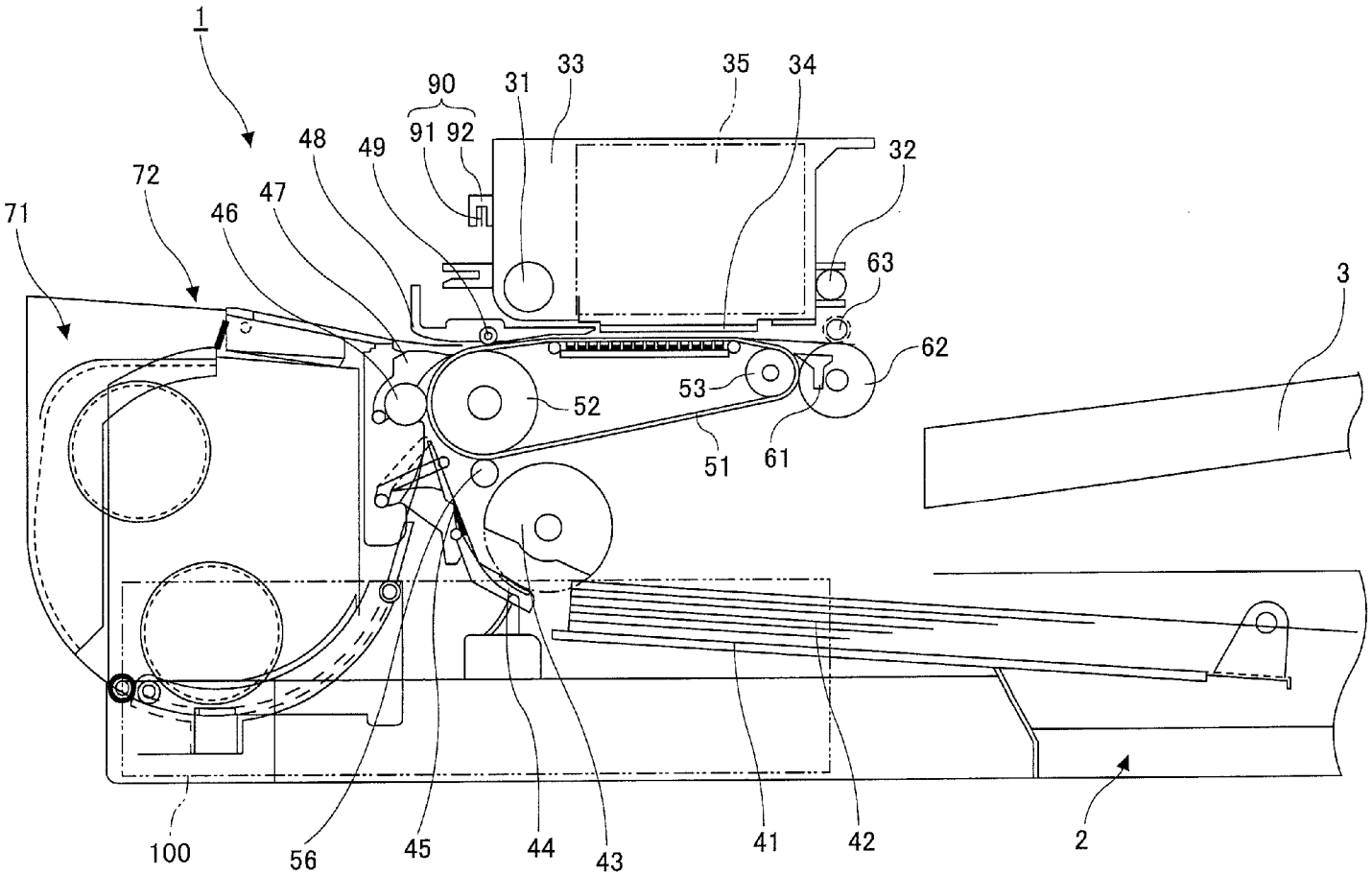
FIG. 1 is a schematic side view of a mechanical part of an image forming apparatus according to a first embodiment of the present invention.
Figure 2:
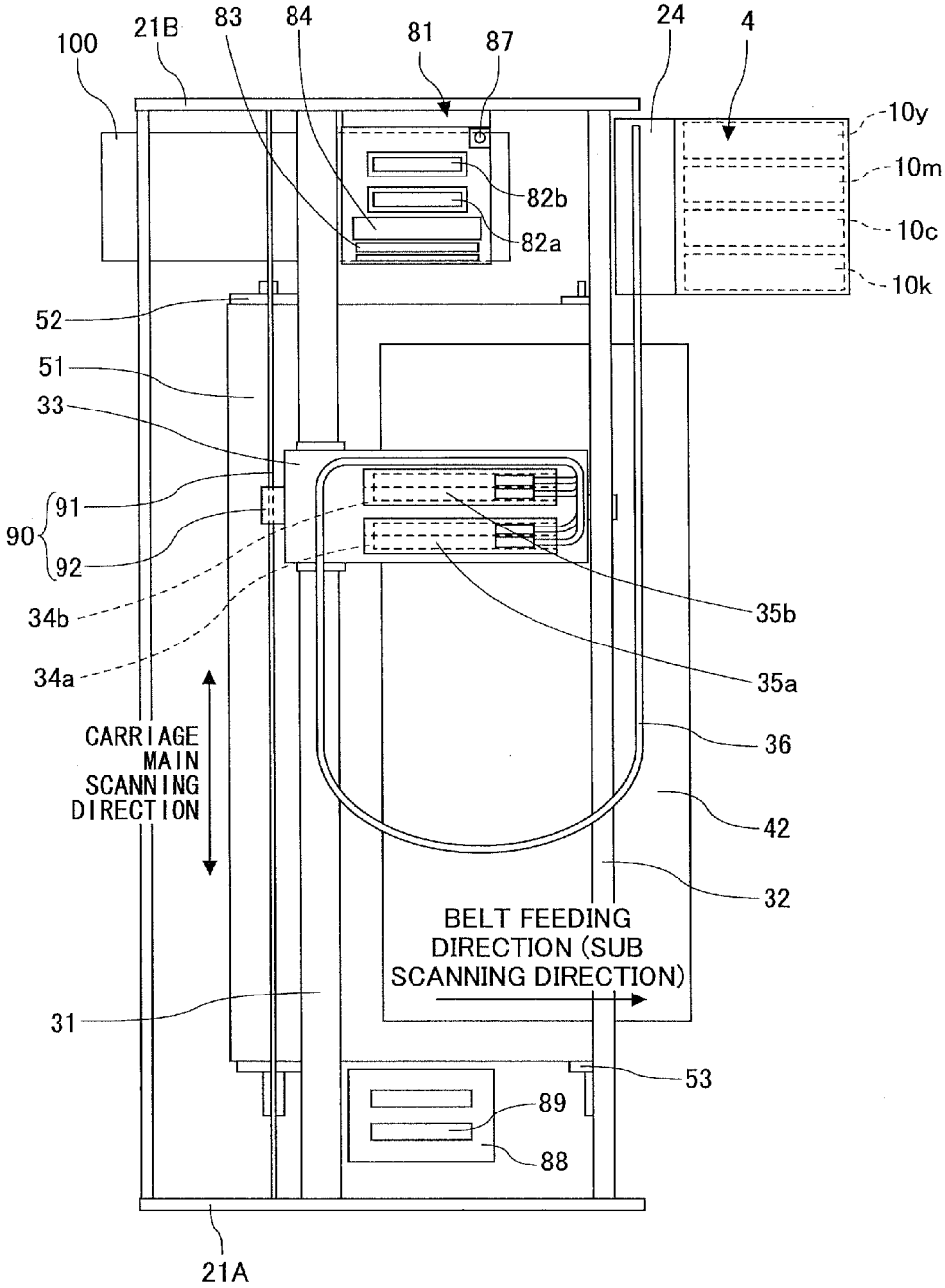
FIG. 2 is a top view of a main part of the mechanical part.

In the following, embodiments of the present invention are described with reference to the accompanying drawings. First, one example of an image forming apparatus according to an embodiment of the present invention is described with reference to FIGS. 1 and 2. FIG. 1 is a side view illustrating the entire configuration of the image forming apparatus. FIG. 2 is a top view of a main part of the apparatus of FIG. 1.

The image forming apparatus is the serial-type image forming apparatus. A carriage 33 is slidably supported in the main scanning direction by a main guide rod 31 and a sub guide rod 32 which are guide members bridged between a side plates 21A and 21B on the left and right sides, respectively, of an apparatus main body 1, so that the carriage 33 can move and scan in the carriage main scanning direction by a main-scanning motor and a timing belt (transfer belt) described below.

The carriage 33 includes recording heads 34*a* and 34*b* (which may be collectively referred to as "recording head 34") discharging ink droplets of yellow (Y), cyan (C), magenta (M), and black (K) colors and having a nozzle line that includes plural nozzles and that is arranged in the sub scanning direction orthogonal to the main scanning direction in a manner such that the ink discharging direction is directed downward.

The recording heads 34 has two nozzle lines, so that one nozzle line of the recording head 34*a* discharges black (K) liquid droplets and the other nozzle line of the recording head 34*a* discharges cyan (C) liquid droplets includes one nozzle line, and one nozzle line of the recording head 34*b* discharges magenta (M) liquid droplets and the other nozzle line of the recording head 34*b* discharges yellow (Y) liquid droplets.

Further, in the carriage 33, sub tanks 35*a* and 35*b* (which may be collectively referred to as "sub tank 35") are mounted for supplying color inks corresponding to the nozzle lines of the recording heads 34. Color recording liquids are supplied from ink cartridges 10*y*, 10*m*, 10*c*, 10*k* (which may be collectively referred to as an "ink cartridge 10") to the respective sub tanks 35 by a supply unit 24 via respective ink supply tubes 36, the ink cartridge 10 which is a main tank detachably mounted on a cartridge mounting section 4.

Further, an encoder scale 91 is provided along the main scanning direction of the carriage 33, and an encoder sensor 92 is provided on the carriage 33 so as to read the encoder scale 91. The encoder scale 91 and the encoder sensor 92 constitute a linear encoder 90, so that a main scanning direction position (carriage position) and a move amount of the carriage 33 can be detected based on a detection signal from the linear encoder 90.

On the other hand, as a sheet feeding section for feeding a sheet 42 piled on a sheet piling section (platen plate) 41 of a sheet feeding tray 2, there are a half moon roller (feed roller) 43 and a separation pad 44. The half moon roller 43 separates and feeds the sheet 42 from the sheet piling section 41 one by one. The separation pad 44 faces the half moon roller 43 and is made of a material having a large friction coefficient.

Further, the separation pad 44 is biased toward the half moon roller 43 side.

Further, in order to further feed the sheet 42 fed from the sheet feeding section to the lower side of the recording head 34, there are provided a guide member 45 guiding the sheet 42, a counter roller 46, a feed guide member 47, a pressing member 48 having a head pressing roller 49, and a transfer belt 51 which is a transmission unit that electrostatically attracts and feeds the sheet 42 to the side facing the recording head 34.

The transfer belt 51 is an endless belt bridged between a feed roller 52 and a tension roller 53 and rotates in the belt feeding direction (sub scanning direction). Further, there is provided a charging roller 56 which is a charging unit charging a surface of the transfer belt 51. The charging roller 56 is in contact with a surface layer of the transfer belt 51, so that the charging roller 56 rotates in accordance with the rotation of the transfer belt 51. The transfer belt 51 is rotated and moved in the belt feeding direction by the rotation of the feed roller 52 driven by a sub scanning motor described below via a timing belt.

Further, as a sheet discharging section for discharging the sheet 42 recorded by the recording head 43, there are provided a separation pawl 61 to separate the sheet 42 from the transfer belt 51, sheet discharging roller 62, a spur 63 which is another discharging roller, and a discharge tray 3 below the discharging roller 62.

Further, a two-sided unit 71 is detachably mounted on the rear part of the apparatus main body 1. The two-sided unit 71 takes in the sheet 42 returned by the rotation in the reverse direction of the transfer belt 51, reverses the sheet 42, and feeds the sheet 42 to between the counter roller 46 and the transfer belt 51 again. Further, there is a manual tray 72 on the upper surface of the two-sided unit 71.

Further, in one non-printing area on one side of the scanning direction of the carriage 33, there is a maintenance and recovery mechanism 81 to maintain and recover the status of the nozzles on the recording head 34. The maintenance and recovery mechanism 81 includes cap members (hereinafter "cap" or "suction cap") B2*a* and 82*b* (which may be collectively referred to as "cap 82") to cap the nozzle surfaces of the recording head 34, a wiper member (wiper blade) 83 to wipe the nozzle surfaces, a preliminary discharge tray 84, and a carriage lock 87 to lock the carriage 33. The preliminary discharge tray 84 receives droplets upon a preliminary discharge that preliminarily discharges thicker recording fluid and that makes no contribution to printing. Further, under the maintenance and recovery mechanism 81, a waste fluid tank 100 is exchangeably provided to the apparatus main body 1 to contain waste fluid produced by the maintenance and recovery operation.

Further, in other non-printing area on the other side of the scanning direction of the carriage 33, there is provided a preliminary discharge tray 88 to receive droplets upon a preliminary discharge that preliminarily discharges recording fluid having been thicker during printing or the like and that makes no contribution to printing. The preliminary discharge tray 88 includes an opening 89 which is open along the nozzle line direction of the recording head 34.

In an image forming apparatus having the configuration described above, the sheet 42 is separated and fed from the feeding tray 2 one by one. Then, the sheet 42 fed substantially in the vertical upward direction is guided by the guide member 45 and further fed in between the transfer belt 51 and the counter roller 46. Then, the header of the sheet 42 is further guided by a transfer guide 37 and pressed toward the transfer belt 51 by the head pressing roller 49 so that the transfer direction of the sheet 42 is changed by approximately 90 degrees.

Then, an alternating voltage alternately repeating a plus output and a minus output is applied to the charging roller 56. As a result the transfer belt 51 is alternately charged to have alternating band voltage pattern in the sub scanning direction (i.e., the rotating direction) in a manner such that plus charges and minus charges are alternately charged and have a predetermined width. When the sheet 42 is fed on the transfer belt 51, the sheet 42 is attracted to the transfer belt 51 and fed in the sub scanning direction by the rotating movement of the transfer belt 51.

Then, by moving the carriage 33 and driving the recording head 34 in accordance with an image signal, ink droplets are discharged onto the halt sheet 42, so as to record one line data. Then, the sheet 42 is fed by a predetermined distance and the data of the next line recorded. Upon receipt of a record end signal or a signal indicating that the tail of the sheet 42 reaches the recording area, the recording operation ends and the sheet 42 is discharged to the discharge tray 3.

On the other hand, to maintain and recover the nozzles of the recording head 34, the carriage 33 is moved to a home position so as to face the maintenance and recovery mechanism 81 and the capping by the cap member 82 is performed. Then, the maintenance and recovery operations such as the nozzle suction operation to suction through the nozzles and the preliminary discharge operation discharging liquid droplets making no contribution to image forming are performed. By doing in this way, it may become possible to stably form an image by discharging liquid droplets.

Figure 3:
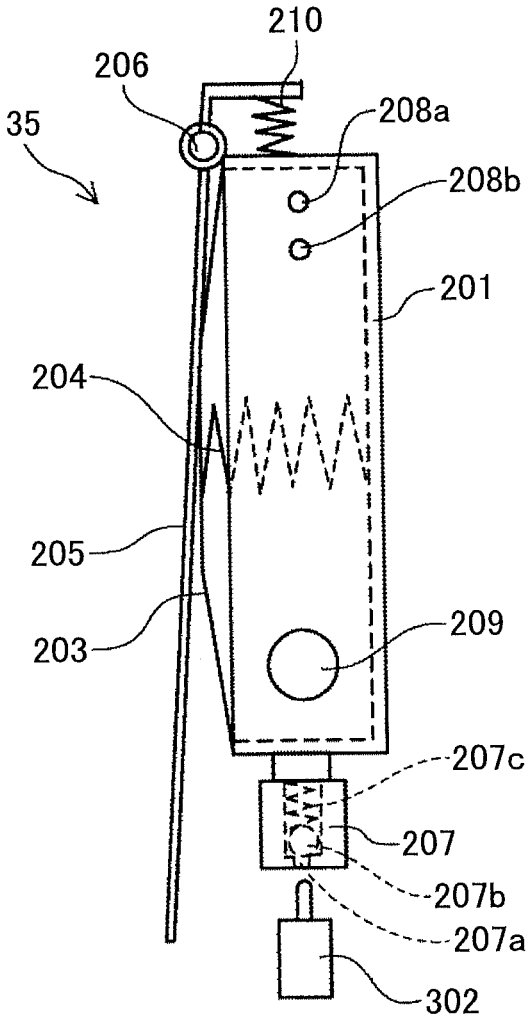
FIG. 3 is a schematic top view illustrating an example of a sub tank.
Figure 4:
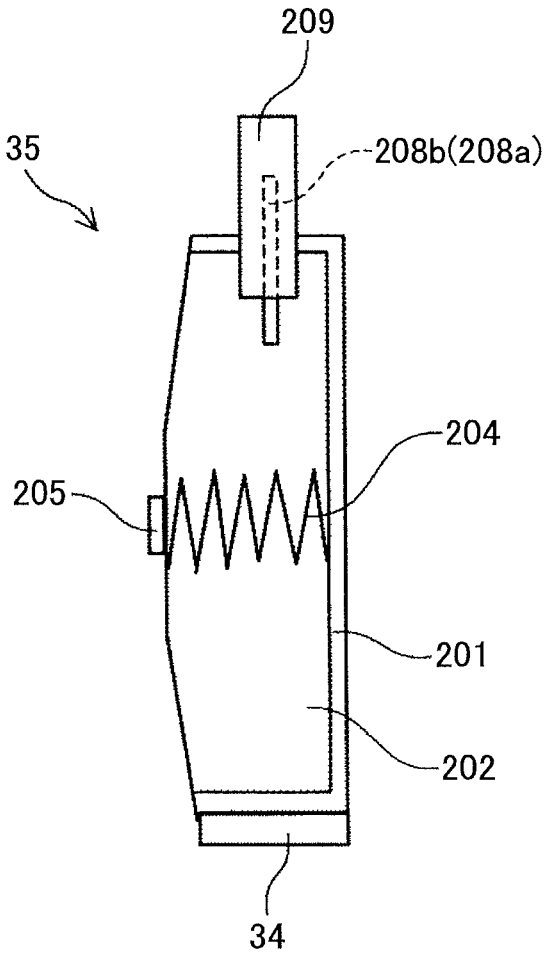
FIG. 4 is a schematic cross-sectional view illustrating the sub tank of FIG. 3.

Next, an example of a sub tank 35 is described with reference to FIGS. 3 and 4. FIGS. 3 and 4 are top and front views, respectively, schematically illustrating the sub tank 35 for one nozzle line.

The sub tank 35 includes a tank case 201 for (defining) (a part of) an ink container 202 storing ink and having an opening on one side of the ink container 202. The opening of the ink container 202 is sealed by a flexible film 203 which is a flexible member so as to define the ink container 202. Further, a spring 204 as an elastic member is disposed in the tank case 201 so as to always bias the flexible film 203 toward outside. Due to the biasing force applied to the flexible film 203 of the tank case 201 toward outside, a negative pressure may be generated (increased) in response to a decrease of a remaining ink amount of the ink container 202 of the tank case 201.

Further, outside of the tank case 201, there is a displacement member 205 (hereinafter may be simplified as "filler") that has one end side swingably supported by a supporting axis 206 and that is biased toward the tank case 201 side by a spring 210. The displacement member 205 is fixed onto the flexible film 203 with glue or the like, so that the displacement member 205 is displaced in accordance with the movement of the flexible film 203. By detecting the displacement member 205 using a second detecting unit (second sensor) 301 provided on the carriage 33 and a first detecting unit (first sensor) 251, it may become possible to detect the remaining ink amount, the negative pressure and the like in the sub tank 35.

The second detecting unit (second sensor) 301 and the first detecting unit (first sensor) 251 are described below.

Further, on the upper side of the tank case 201, a supply opening 209 to supply ink from the ink cartridge 10 is formed and connected to the ink supply tube 36. Further, on one side part of the tank case 201, an air opening mechanism 207 to open the inside of the sub tank 35 to the atmosphere is formed. The air opening mechanism 207 includes a valve body 207*b* to open and close an air opening path 207*a* in communication with the inside of the sub tank 35 and a spring 207*c* biasing the valve body 207*b* so as to close the air opening path 207*a*. The air opening path 207*a* is open when an air opening solenoid 302 is used to press the valve body 207*b*, so that the inside of the sub tank 35 is in communication with the atmosphere (air opened state).

Further, there are provided electrode pins 208*a* and 208*b* to detect an ink fluid surface height in the sub tank 35. Ink is electrically conductive. Therefore, when ink is in contact with the electrode pins 208*a* and 208*b*, a current flows between the electrode pins 208*a* and 208*b*, thereby changing the resistance value between the electrode pins 208*a* and 208*b*. By using the characteristics, it may become possible to detect where the ink fluid surface height is equal to or lower than a predetermined height, in other words where an amount of air in the sub tank 35 is equal to or greater than a predetermined amount.

Figure 5:
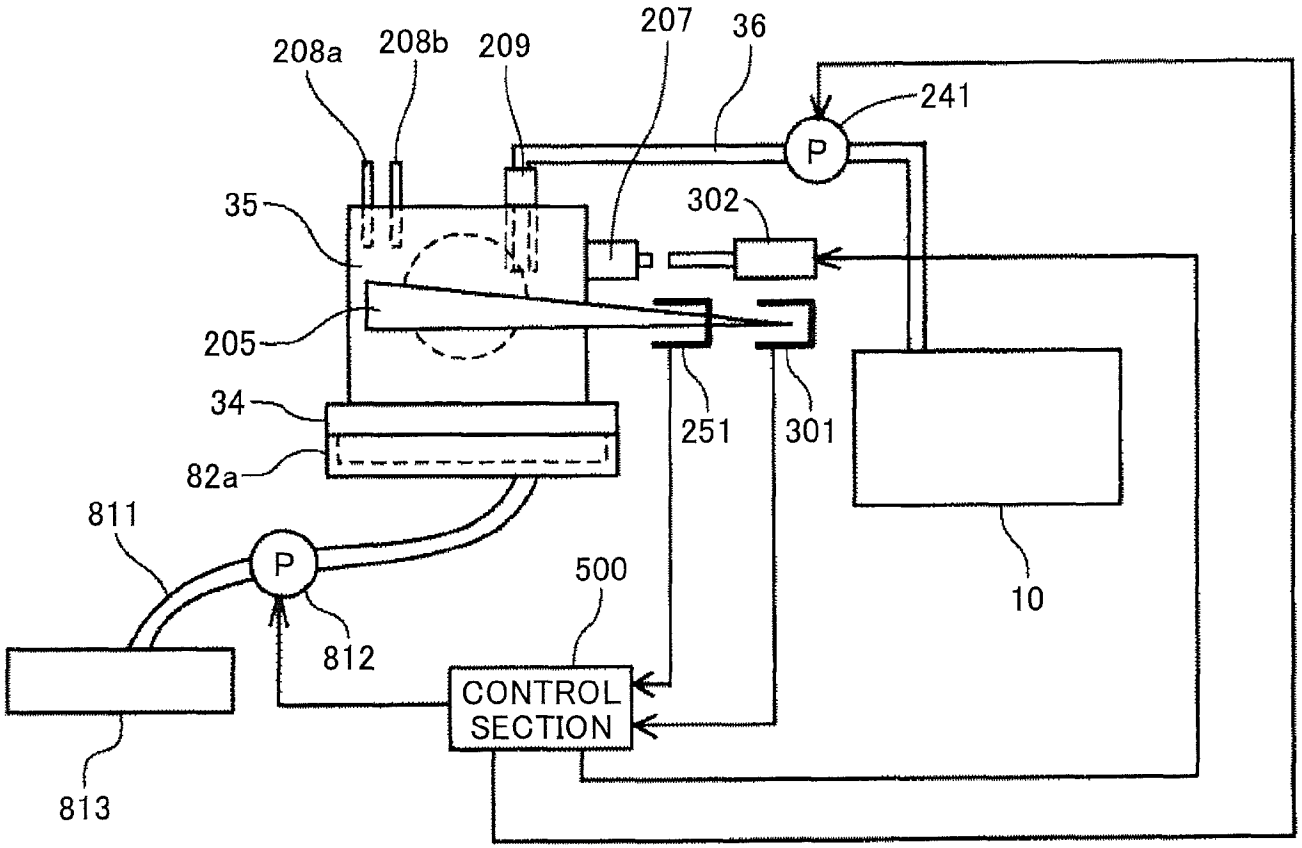
FIG. 5 is a schematic drawing illustrating an ink supply exhaust system.

Next, an ink supply exhaust system in the image forming apparatus is described with reference to FIG. 5. First, an ink supply from the ink cartridge (hereinafter may be referred to as a "main tank") 10 to the sub tank 35 is performed by a fluid feed pump 241 which is a fluid feeding unit of the supply unit 24 via the ink supply tube 36. The fluid feed pump 241 is a reversible pump such as a tube pump, so that the fluid feed pump 241 can perform operations of supplying ink from the ink cartridge 10 to the sub tank 35 and supplying ink from the sub tank 35 back to the cartridge 10.

Further, as described above, the maintenance and recovery mechanism 81 includes a suction pump 812 which is in communication with the suction caps 82*a* and 82*b* capping the nozzle surfaces of the recording head 31. While the nozzle surfaces of the recording head 34 are capped by the caps 82*a* and 82*b*, by suctioning ink from the nozzles via a suction tube 811 by driving the suction pump 812, ink in the sub tank 35 may be suctioned. The suctioned ink is exhausted to a waste fluid tank 813.

Further, as described above, the air opening solenoid 302 is disposed on the apparatus main body side and is a pressing member to open and close the air opening mechanism 207 of the sub tank 35. By operating the air opening solenoid 302, the air opening mechanism 207 can be open.

Further, the first sensor 251 which is an optical sensor as first detecting unit to detect the displacement member 205 is provided on the carriage 33. Also, the second sensor 301 which is an optical sensor as the second detecting unit to detect the displacement member 205 is provided on the apparatus main body side. As described below, based on the detection results of the first sensor 251 and the second sensor 301, an ink supply operation to supply ink to the sub tank 35 is controlled.

The control of driving the fluid feed pump 241, the air opening solenoid 302, and the suction pump 812 and the ink supply operation according to an embodiment of the present invention are performed by a control section 500 described below.

Figure 6:
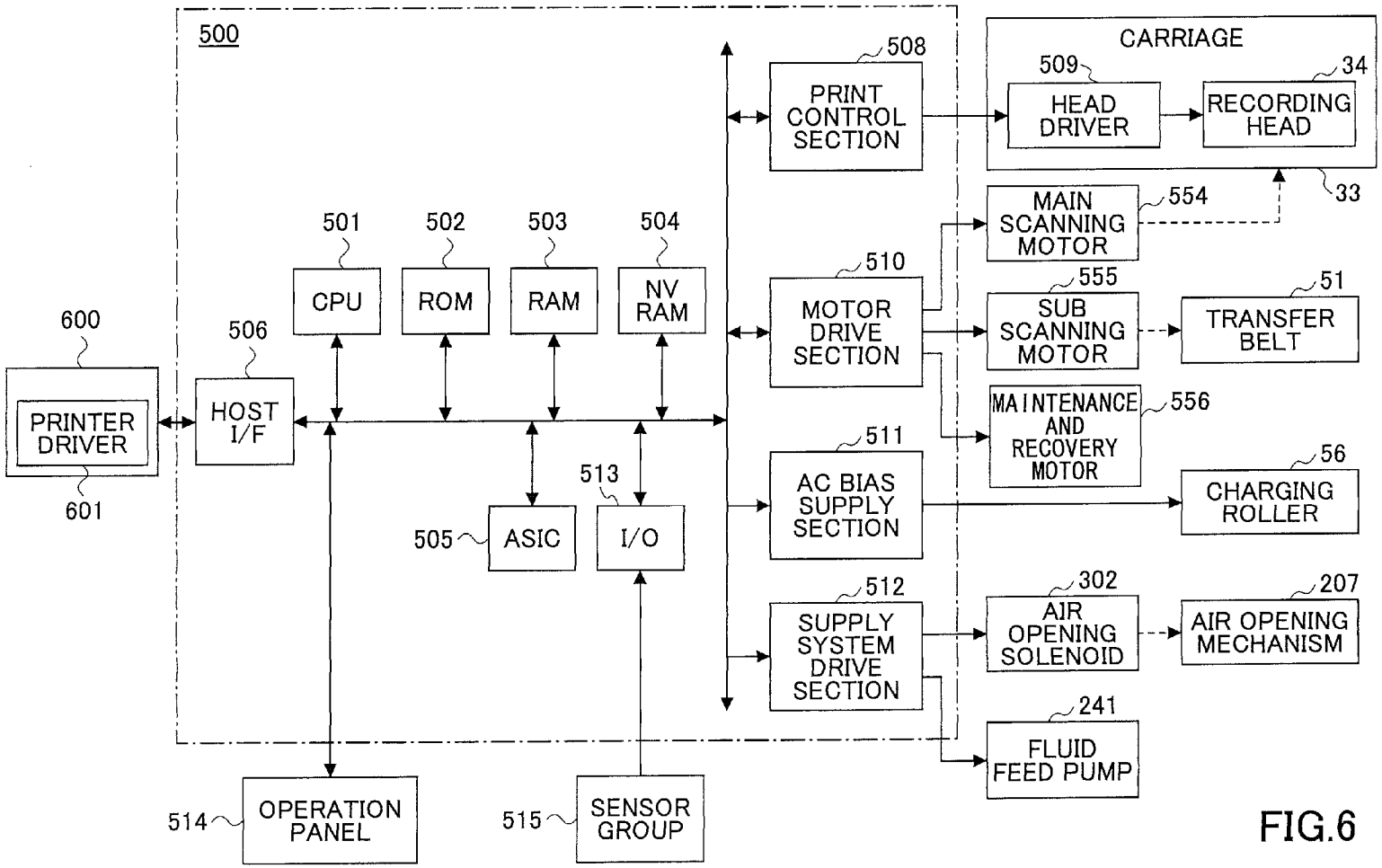
FIG. 6 is a block diagram schematically illustrating a control section.

Next, the outline of the control section 500 of the image forming apparatus is described with reference to FIG. 6. FIG. 6 is a block diagram of the entire control section 500.

The control section 500 controls the entire apparatus, and includes a CPU 501, a ROM 502, a RAM 503, a rewritable non-volatile memory 504, and an ASIC 505. The CPU 501 serves as a control unit according to an embodiment of the present invention. The ROM 502 stores a program and other data executed by the CPU 501. The RAM 503 temporarily stores image data and the like. The non-volatile memory 504 stores data even when the power of the apparatus is turned OFF. The ASIC 505 performs various signal processing on image data, an image processing such as a process of changing the order of data, and processing on input and output signals to control the entire apparatus and the like.

The control section 500 further includes a print control section 508, a motor drive section 510, an AC bias supply section 511, and a supply system drive section 512. The print control section 508 includes a data transfer unit and a drive signal generation unit to drive and control the recording head 34. The motor drive section 510 drives a head driver (driver IC) 509 to drive the recording head 34 provided on the carriage 33 side, a main scanning motor 554 to move and scan the carriage 33, a sub scanning motor 555 to rotate and move the transfer belt 51, and a maintenance and recovery motor 556 of the maintenance and recovery mechanism 81. The AC bias supply section 511 supplies an AC bias to the charging roller 56. The supply system drive section 512 drives the air opening solenoid 302 and the fluid feed pump 241, the air opening solenoid 302 being provided on the apparatus main body side so as to open and close the air opening mechanism 207 of the sub tank 35.

Further, the control section 500 is connected to an operation panel 514 displaying information necessary for the apparatus and accepting the input of the information.

The control section 500 further includes a host interface ("I/F") 506 for transmitting and receiving data and signals from and to a host side, so that the I/F 506 of the control section 500 receives the data and the signals from a host 600 including an image processing apparatus such as a personal computer, an image reading apparatus such as an image scanner, an image acquisition apparatus such as a digital camera and the like via a cable or a network.

Further, the CPU 501 the control section 500 reads and analyzes the print data in a receiving buffer of the I/F 506. The ASIC 505 performs a process of changing the order of the data and the like, and the image data are transferred from the print control section 508 to the head driver 509. Further, the dot pattern data for the image output are generated by a printer drive 601 on the host 600 side.

The print control section 508 transfers the image data as serial data, and outputs the transfer clock signal, the latch signal, the control signal and the like necessary for the transfer of the image data and the confirmation of the transfer. Further, the print control section 508 includes a D/A converter to perform D/A conversion on the pattern data of driving pulse stored in the ROM 502, a voltage amplifier, and a drive signal generator including a current amplifier, and outputs a drive signal including one or more drive pulses to the head driver 509.

The head driver 509 drives the recording head 34 by applying a drive pulse of the drive signal to a drive element (e.g., piezoelectric device), the drive signal being given from the print control section 508 based on the image data corresponding to one line of the recording head 34 and being input in series, the drive element generating energy for selectively discharging liquid droplets from the recording head 34. In this case, by selecting the drive pulse of the drive signal, it becomes possible to select different sizes of dots such as large droplets, middle-sized droplets, and small droplets.

An I/O section 513 (of the control section 500) acquires information from a sensor group 515 equipped in the apparatus and extracts information necessary for controlling the printer, so that the extracted information is used in, for example, the print control section 508, the motor drive section 510, the control of the AC bias supply section 511, and the control of the ink supply to the sub tank 35.

The sensor group 515 includes not only the first sensor, the second sensor, and the detection electrode pins 208*a* and 208*b* that are described above but also an optical sensor to detect a position of the sheet, a thermistor (an environment temperature sensor, an environment humidity sensor) to the temperature and humidity of the apparatus, a sensor to monitor the voltage of a charged belt, an interlock switch and the like. The I/O section 513 can perform processing on the various sensor information.

Next, a negative pressure forming operation of the sub tank 35 in the image forming apparatus having the above configuration is described with reference to FIGS. 7A and 7B.

Figure 7A:
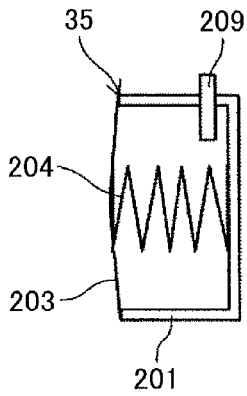
FIGS. 7A and 7B are drawings illustrating a negative pressure forming operation of the sub tank.
Figure 7B:
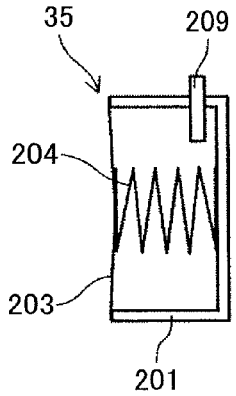

As illustrated in FIG. 7A, after ink is supplied from the main tank 10 to the sub tank 35, ink is suctioned from the sub tank 35 as described above or the recording head 34 is driven to discharge droplets (i.e., preliminary discharge making no contribution of image forming) to reduce the ink amount in sub tank 35. By doing this, as illustrated in FIG. 7B, the flexible film 203 is likely to resist the bias force of the spring 204 and be displaced inward. As a result, due to the bias force of the spring 204, a negative pressure is generated in the sub tank 35.

Further, by suctioning the inside of the sub tank 35 using the spring 204 and the flexible film 203 is pulled inside the sub tank 35. As a result, the spring 204 is further compressed, thereby increasing the negative pressure.

In this status, ink is supplied to the inside of the sub tank 35, the flexible film 203 is pushed to the outside of the sub tank 35. As a result, the spring 204 is extended, thereby reducing the negative pressure.

By repeating the above operations, it may become possible to control the negative pressure of the inside of the sub tank 35 to be in a certain range.

Figure 8:
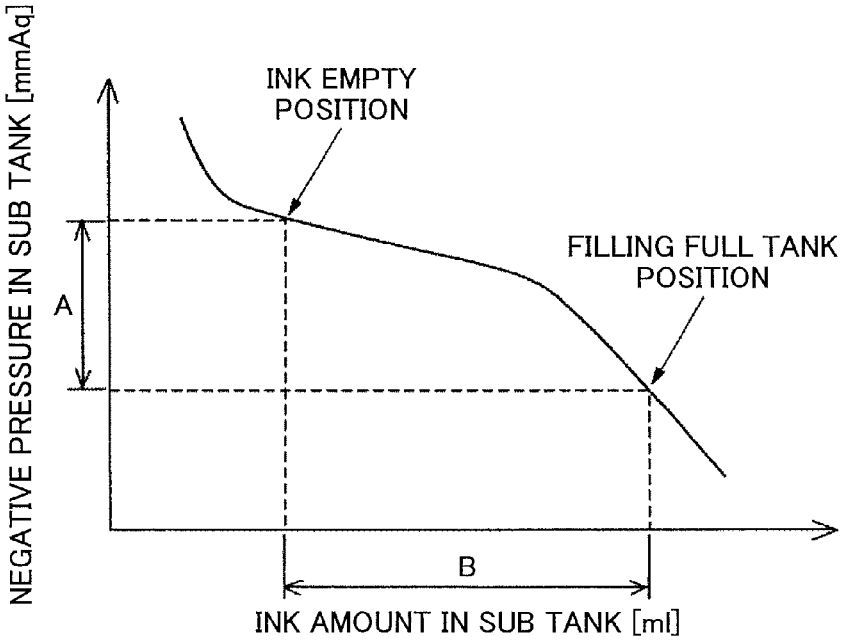
FIG. 8 is a graph illustrating a relationship between the negative pressure and an ink amount in the sub tank.

Namely, as illustrated in FIG. 8, there is a correlation between the negative pressure in the sub tank 35 and the ink amount in the sub tank 35. Specifically, when the ink amount is large in the sub tank 35, the negative pressure in the sub tank 35 is low and weak. On the other hand, when the ink amount is small, the negative pressure in the sub tank 35 is high and strong. Further, when the negative pressure in the sub tank 35 is too weak (low), ink may be leaked from the recording head 34. On the other hand, when the negative pressure is too strong (high), air or dust may be introduced through the recording head 34, which may be more likely to cause discharge failure.

To avoid the problem, ink supply to the sub tank 35 is controlled in a manner such that the ink amount is in a range B of ink amount in the sub tank corresponding to a predetermined negative pressure control range A of the negative pressure in the sub tank 35. In the following, the ink amount in the sub tank 35 corresponding to the lower limit value (i.e., negative pressure value is small and ink amount is large) of the negative pressure control range A is called a "filling full tank position" as the displacement position of the displacement member 205. On the other hand, the ink amount in the sub tank 35 corresponding to the higher limit value (i.e., negative pressure value is large and ink amount is small) of the negative pressure control range A is called a "ink empty position" as the displacement position of the displacement member 205.

Figure 9A:
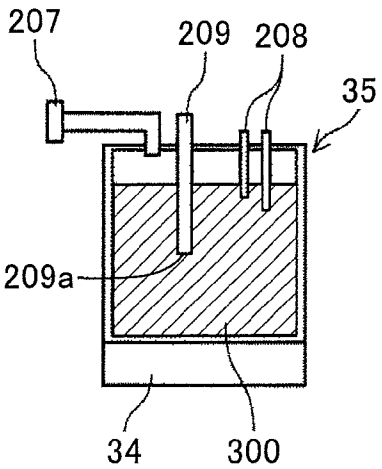
FIGS. 9A through 9C are drawings illustrating a method of setting the ink amount of the sub tank to a full tank.
Figure 9B:
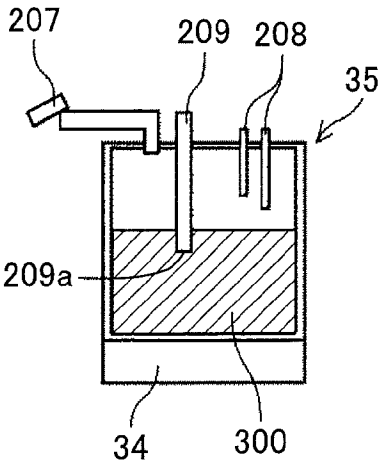

Next, a method of setting the ink amount in the sub tank 35 to the filling full tank position is described with reference to FIGS. 9A through 9C. In the following figures, unlike the sub tank 35 in FIGS. 3 and 4, the sub tank 35 is more schematically described.

First, in a state of 9A, the negative pressure in the sub tank 35 is open by opening the air opening mechanism 207. By doing this, as illustrated in FIG. 96B, the fluid surface in the sub tank 35 is lowered. Further, in this case, preferably, the supply opening 209*a* of the supply opening section 209 is below the fluid surface. Namely, if the supply opening 209*a* is higher than the fluid surface, air may be introduced in the ink supply tube 36 via e supply opening 209*a* or the supply opening section 209. As a result, when ink is supplied next, bubbles as well as ink may be exhausted from the supply opening 209*a*. When ink supply is continued, the bubbles may be attached to the inside of the air opening mechanism 207, which may cause fixation of the valve or leakage.

Figure 9C:
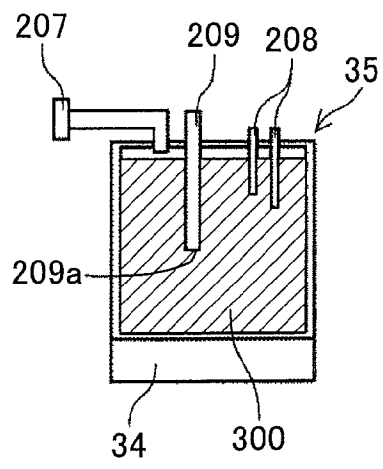

Then, after the negative pressure of the sub tank 35 is released and the fluid surface is lowered, as illustrated in FIG. 9C, ink 300 is supplied. By supplying ink 300, the fluid surface is raised. In this case, ink 300 is supplied until the electrode pins 208*a* and 208*b* detect the fluid surface having a predetermined height (i.e., until the fluid surface reaches a predetermined height). After that, the air opening mechanism 207 is closed and a predetermined amount of ink is suctioned or exhausted, the negative pressure is a predetermined negative pressure. As a result, it may become possible to set the ink amount in the sub tank 35 to the filling full tank position where a predetermined negative pressure value is obtained.

Next, the detection of the displacement amount of the displacement member 205 of the sub tank 35 is described with reference to FIGS. 10A and 10B and FIGS. 11A through 11D.

Figure 10A:
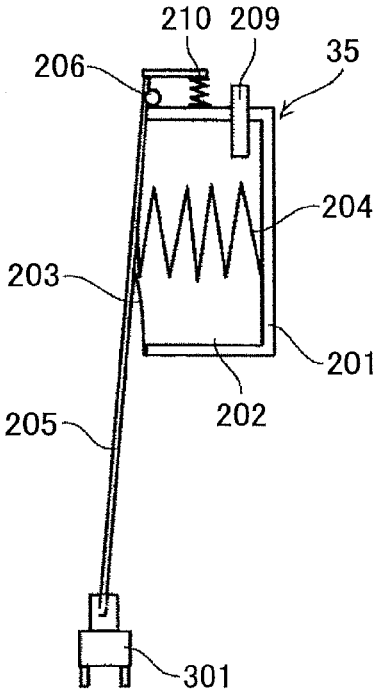
FIGS. 10A and 10B are drawings illustrating a method of setting the ink amount of the sub tank to the full tank using only a second sensor.
Figure 10B:
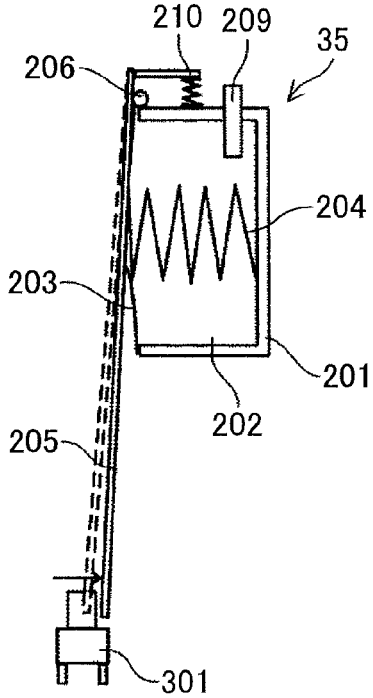

First, with reference to FIGS. 10A and 10B, a case is described where the displacement amount is detected using only a second sensor (full tank detection sensor) 301 provided on the apparatus main body side. As illustrated in FIG. 10A, the position of the carriage 33 (carriage position: obtained by the linear encoder 90) when the second sensor 301 detects the displacement member 205 of the sub tank 35 is stored. Next, as illustrated in FIG. 10B, when the displacement member 205 moves from the position described in the dotted line to the position described in the solid line, by moving the carriage 33 until the carriage detects the displacement member 205, it may become possible to obtain a displacement amount (carriage movement amount) based on the difference from the stored carriage position.

In this case, in order to set the ink amount of the sub tank 35 to the filling full tank position, for example, as described above, after opening the air opening mechanism 207 so that the pressure in the sub tank 35 is vented to the atmosphere, ink is supplied until the fluid surface is raised to a predetermined position where electrode pins 208 detect the fluid surface and the air opening mechanism 207 is closed. Then, the carriage 33 is scanned so as to detect the displacement member 205 by the second sensor 301. Then, the carriage position when the second sensor 301 detects the displacement member 205 is stored as air opened position. Next, a predetermined amount of ink is suctioned or discharged from the recording head 34 so that the predetermined amount of ink is suctioned from the sub tank 35. By doing this, the negative pressure is generated and the position of the displacement member 205 is stored as the filling full tank position. In this case, as described above, the predetermined amount of ink is suctioned upon the air opened position, the position of the displacement member 205 at the filling full tank position is disposed inside the position of the displacement member 205 at the air opened position.

With the configuration above, however, when ink is supplied to the filling full tank position of the sub tank 35, it is necessary to detect the displacement amount of the displacement member 205 of the sub tank 35. Therefore, the carriage 33 is required to be moved so that the second sensor 301 can detect the displacement member 205 each time.

Figure 11A:
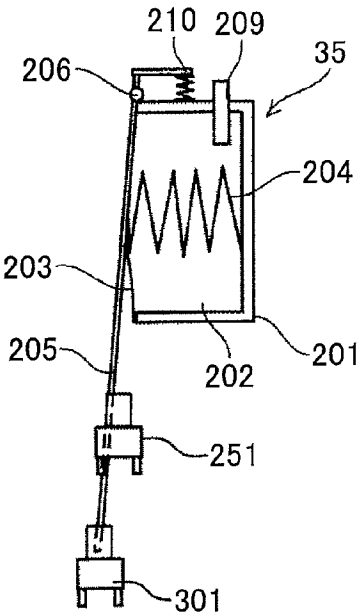
FIGS. 11A through 11D are drawings illustrating a method of setting the ink amount of the sub tank to full tank using a first sensor and the second sensor.

To resolve the problem, in this embodiment of the present invention, as illustrated in FIGS. 11A through 110, in addition to the second sensor 301 provided on the apparatus main body side, the first sensor 251 to detect the displacement member 205 of the sub tank 35 is provided on the carriage 33.

Namely, the position where the second sensor 301 on the apparatus main body side detects the displacement member 205 is called a second position, and the second position is the filling full tank position. On the other hand, the position where the first sensor 251 on the carriage 33 side detects the displacement member 205 is called a first position. It is assumed that the remaining ink amount at the first position is less than the remaining ink amount at the second position.

In other words, herein, the carriage 33 is equipped with the first detection unit (first sensor) to detect a state where the displacement member 205 is disposed at the predetermined first position. On the other hand, the apparatus main body 1 is equipped with the second detection unit (second sensor) to detect a state where the displacement member 205 is disposed at the predetermined second position (filling full tank position) when the carriage is stopped at a predetermined detecting position (full tank detecting position) and fluid is supplied from the main tank 10 to the sub tank 35. Further, it is assumed that the remaining ink amount at the first position is less than the remaining ink amount at the second position.

Figure 11B:
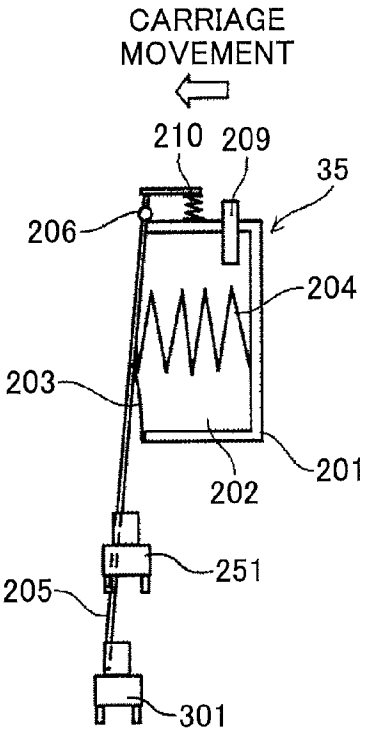
Figure 11C:
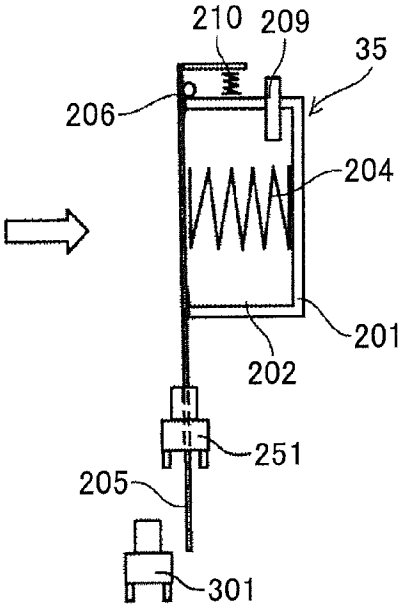
Figure 11D:
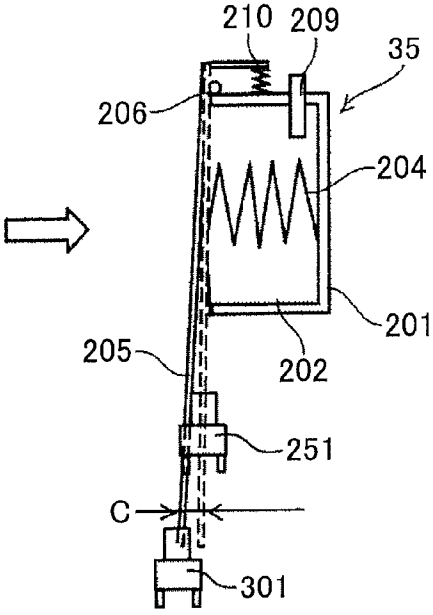

In order to set the ink amount of the sub tank 35 to the filling full tank position (i.e., ink supply is performed up to the filling full tank position), as illustrated in FIG. 11A, at the air opened position where the displacement member 205 is detected by the second sensor 301, the carriage 33 is moved to the detecting position for detecting the filling full tank position as illustrated in FIG. 11B. Then, as illustrated in FIG. 11C, the fluid feed pump 241 is reversibly driven to suction ink from the sub tank 35 to the main tank 10 side until the displacement member 205 passes through the position where the displacement member 205 is detected by the first sensor 251. After that, the fluid feed pump 241 is normally driven to supply ink from the main tank 10 to the sub tank 35, and as illustrated in FIG. 11D, the ink supply is stopped when the second sensor 301 detects the displacement member 205 (at the filling full tank position).

In this case, by detecting the fluid feed amount by the fluid feed pump 241 from when the first sensor 251 detects the displacement member 205 until when the second sensor 301 detects the displacement member 205, it may become possible to obtain a displacement amount C which is an amount of the displacement of the displacement member 205 (flexible film 203) from the detecting position of the first sensor 251 to the detecting position of the second sensor 301. A supply amount corresponding to the displacement amount C is a differential supply amount. Therefore, the supply amount is stored as the differential supply amount.

In this case, the displacement amount C may be obtained as a time period (driving time of the fluid feed pump 241) or the number of rotations (the number of rotations driven by the fluid feed pump 241) from when the first sensor 251 detects the displacement member 205 until when the second sensor 301 detects the displacement member 205.

As described above, the differential supply amount (displacement amount C) is obtained and stored first. Then, in a case where it is detected that a predetermined amount of ink is discharged during the scanning the carriage 33 (i.e., when ink consumption amount is equal to or greater than the predetermined amount), by supplying ink from the main tank 10 to the sub tank 35 and further supplying the differential supply amount of ink after the first sensor 251 detects the displacement member 205, it may become possible to supply ink up to the filling full tank position.

In this case, the detection by the first sensor 251 is to detect a position. Therefore, accumulated errors including a detection error of ink discharge amount and a detection error of a fluid feed amount of the fluid feed pump 241 may be cancelled upon the detection by the first sensor 251. Therefore, detection errors may not be accumulated, and even during the scanning operation of the carriage, ink discharge and ink supply may be repeatedly performed.

By repeating the procedures described above, it may become possible to always supply ink to the sub tank 35 to the filling full tank position without stopping the printing operation, thereby improving the printing speed and printing efficiency.

Next, other exemplary arrangements of the first sensor and the second sensor are described with reference to FIGS. 12 and 13.

Figure 12:
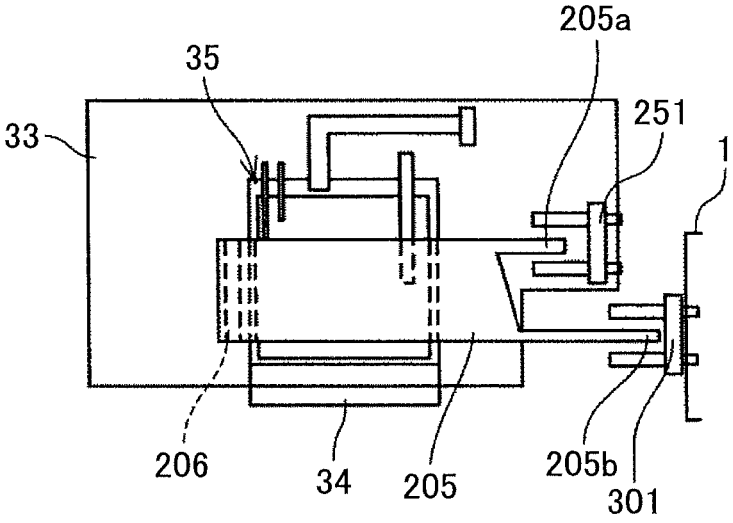
FIG. 12 is a drawing illustrating an example of an arrangement of the first sensor and the second sensor.

FIG. 12 illustrates an exemplary configuration where the displacement member 205 of the sub tank 35 is swingably supported by a supporting axis (swingably supporting point) 206, and two detecting sections 205*a* and 205*b* are extended from the supporting axis 206 and have different length from each other, so that the first sensor 251 on the carriage 33 and the second sensor 301 on the apparatus main body side detect the detecting sections 205*a* and 205*b*, respectively.

Figure 13:
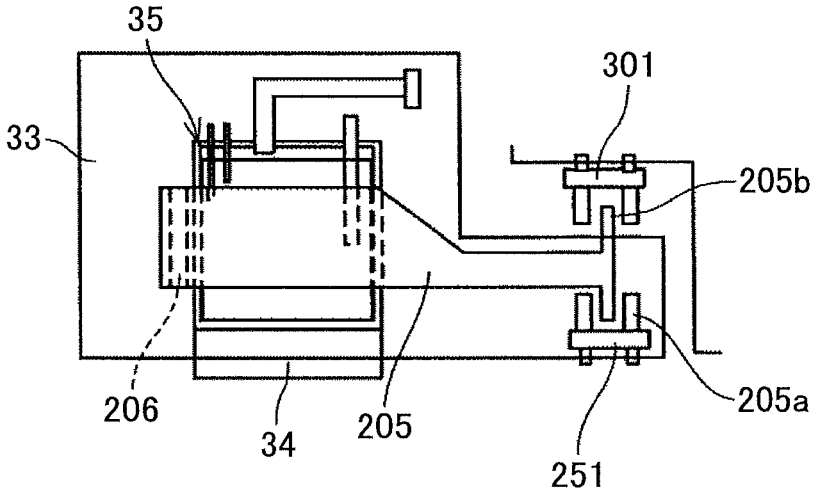
FIG. 13 is a drawing illustrating another example of the arrangement of the first sensor and sensor.

FIG. 13 illustrates another exemplary configuration where the displacement member 205 of the sub tank 35 is swingably supported by a supporting axis (swingably supporting point) 206, and two detecting sections 205*a* and 205*b* are extended from the supporting axis 206 and have the same length, so that the first sensor 251 on the carriage 33 and the second sensor 301 on the apparatus main body side detect the detecting sections 205*a* and 205*b*, respectively.

Next, a supply amount of ink to the sub tank 35 during printing operation based on the detected displacement amount C is described.

In this case, if the detected displacement amount C is a small amount equal to or less than a predetermined lower limit value so that the fluid feed pump 241 hardly drives, when fluid is fed during printing operation, the differential supply amount after the detection of the displacement member 205 by the first sensor 251 is set to the amount corresponding to the predetermined lower limit value. On the other hand, if the detected displacement amount C is equal to or greater than a predetermined upper limit value, the differential supply amount is set to the predetermined upper limit value after the displacement member 205 is detected by the first sensor 251.

Figure 14:
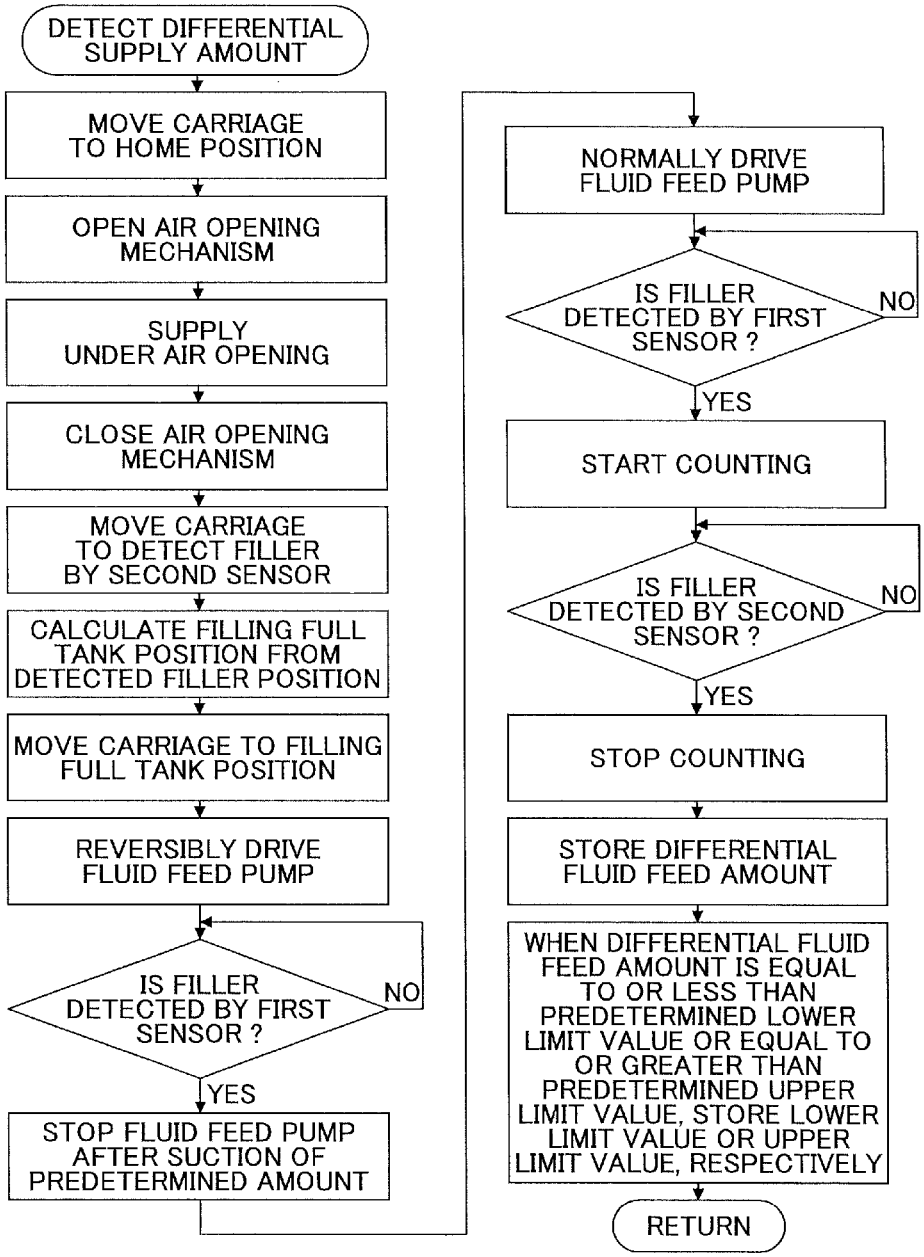
FIG. 14 is a flowchart illustrating a detecting process of detecting a differential supply amount by the control section.

Next, the control of the operations described above is described with reference to the flowcharts of FIGS. 14 and 15.

First, in the differential supply amount detecting process, the carriage is moved to its home position. Capping is performed using the cap 82*a*. The air opening mechanism 207 of the sub tank 35 is open. While detecting the fluid surface with the electrode pins 208*a* and 208*b*, an atmosphere open filling is performed, namely ink is supplied from the main tank 10 to the sub tank 35.

After that, the air opening mechanism 207 of the sub tank 35 is closed. While the carriage 33 is moved and the movement amount is detected, the displacement member 205 of the sub tank 35 is detected by the second sensor 301, and the filling full tank position is calculated.

Next, the carriage 33 is moved to the filling full tank position. The fluid feed pump 241 is reversibly driven to suction inside the sub tank 35. The suction is continued until the displacement member 205 of the sub tank 35 passes through the first sensor 251.

After that, the fluid feed pump 241 is normally driven to supply ink from the main tank 10 to the sub tank 35. The ink is supplied until the first sensor 251 detects the displacement member 205 of the sub tank 35. The ink is further supplied until the second sensor 301 detects the displacement member 205 of the sub tank 35. Then, the fluid feed pump 211 stops.

Then, the fluid feed amount (e.g., driving time period or the number of rotations of the fluid feed pump 241) from when the first sensor 251 detects the displacement member 205 of the sub tank 35 until when the second sensor 301 detects the displacement member 205 of the sub tank 35 is calculated.

When the calculated fluid feed amount is equal to or less than a predetermined lower limit value, the predetermined lower limit value is stored as the differential supply amount. On the other hand, when the calculated fluid feed amount is equal to or greater than a predetermined upper limit value, the predetermined upper limit value is stored as the differential supply amount. When the calculated fluid feed amount is in a range between the predetermined lower limit value and the predetermined upper limit value, the calculated fluid feed amount is stored as the differential supply amount.

By doing in this way, the carriage is stopped at the position where the detecting position of the second sensor 301 is the filling full tank position. The ink is supplied from the main tank 10 to the sub tank 35. The differential supply amount corresponding to the displacement amount of the displacement member 205 from when the first sensor 251 detects the displacement member 205 until when the second sensor 301 detects the displacement member 205 is detected and stored.

Figure 15:
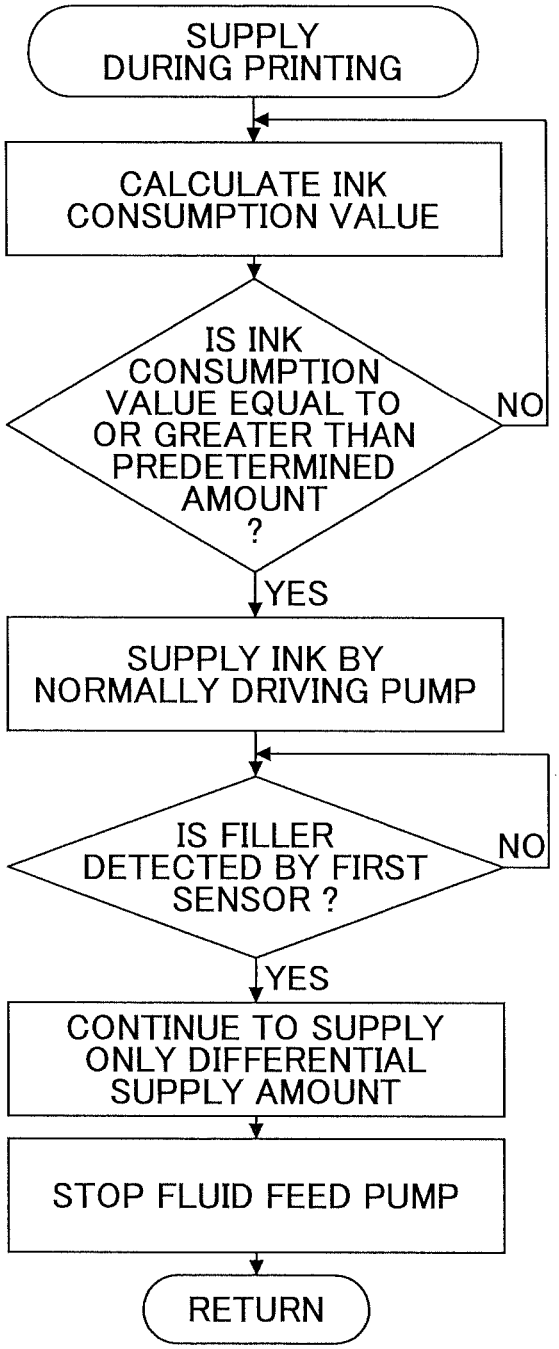
FIG. 15 is a flow chart illustrating a process of supplying ink during printing.

Next, with reference to FIG. 15, an ink supply process during printing operation is described. First, an ink consumption amount of the sub tank 35 is calculated. This calculation of the ink consumption amount is theoretically performed by, for example, counting the number of droplets discharged for image forming and the number of droplets discharged for the preliminary charge operation and multiplying the counted value by the droplet amount of the droplets. Further, when the cleaning operation is performed to suction ink from the recording head 34, the suction amount due to the cleaning operation is to be added. This is because, the consumption amount (suction amount) due to the cleaning operation is predetermined.

Then, it is determined whether the calculated remaining ink amount based on the ink amount at the filling full tank position and the ink consumption amount reaches a predetermined value. When determined that the remaining ink amount reaches the predetermined value, the fluid feed pump 241 is driven to normally rotate to supply ink from the main tank 10 to the sub tank 35. In this case, it is determined whether the first sensor 251 detects the displacement member 205 of the sub tank 35. When determining that the first sensor 251 detects the displacement member 205 of the sub tank 35, from that time point, the differential supply amount of ink is further supplied to the sub tank 35. By doing this, ink is supplied to the filling full tank position to the sub tank 35.

After that, the fluid feed pump 241 is stopped, and the calculation value of the ink consumption value is reset.

By doing in this way, even during printing operation, it may become possible to supply ink to the sub tank 35 to the filling full tank position without returning the carriage 33 to its home position.

As described above, according to this embodiment of the present invention, the sub tank is equipped with a displacement member that is displaced depending on the remaining ink amount of the sub tank. Further, the carriage is equipped with the first detection unit to detect that the displacement member is disposed at the first position. On the other hand, the apparatus main body is equipped with the second detection unit to detect that the displacement member is disposed at the second position. The first position indicates that the remaining ink amount of the sub tank is less than the remaining ink amount at the second position. The differential supply amount corresponding to the displacement amount of the displacement member between the position detected by the first detection unit and the position detected by the second detection unit is detected and stored. In a case where fluid is supplied from the main tank to the sub tank without using the second detection unit, after the first detection unit detects the displacement member, control is performed so that the differential supply amount of liquid is supplied to the sub tank. By having a configuration described above, it may become possible to supply an appropriate amount of ink from the main tank to the sub tank even if the carriage is being moved, thereby enabling improving the printing speed.

Herein, a reason why the second sensor is provided on the apparatus main body side without detecting using the first sensor 251 on the carriage 33 side alone is described.

First, the position where the sub tank is filled up as a full tank may differ depending on the environmental conditions, and the change amount depending on the environmental conditions may not be recognized (obtained) because only one first sensor 251 can detect only one point position, the first sensor being mounted on the carriage 33. To resolve the problem, by providing the second sensor 251 on the apparatus main body side, it may become possible to detect the air opened position and the full tank detecting position by moving the carriage 33.

Namely, the distance between the detecting point fixed on the carriage 33 and the detecting point that is a movable detecting position by moving the carriage 33 is detected as the time period or the number of rotations of the pump. Otherwise, the distance between the two points may be detected based on the encoder count by moving the carriage. Therefore, it may become possible to perform (select) supply amount control depending on the environments.

Further, if a sensor and an encoder are provided so as to detect all the displacement on the carriage 33 alone, the cost of the detecting unit may be increased and the size of the carriage is also increased, thereby increasing the size of the apparatus.

Further, the fluid feed amount (supply amount and suction amount) of the fluid feed pump may vary due to environments, elapse of time, variations of parts of the pump and the like. Therefore, it may be necessary to detect the pump supply amount to the detecting position by the second sensor 301 on the apparatus main body side, the pump supply amount varying depending on the environments, based on the position detection using a sensor. From this point of view, if control is to be performed only based on the drive amount of the fluid feed pump, a problem such as excessive supply or supply shortage may occur. To avoid such a problem, the second sensor 301 is provided on the apparatus main body side to ensure the safety (reliability) of the control.

Figure 16A:
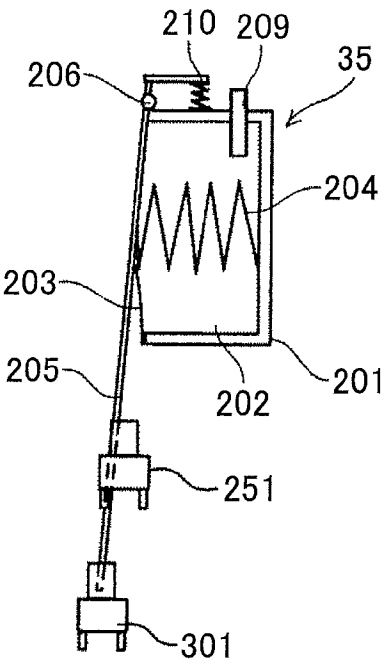
FIGS. 16A through 16C are schematic views of a sub tank according to a second embodiment of the present invention.
Figure 16B:
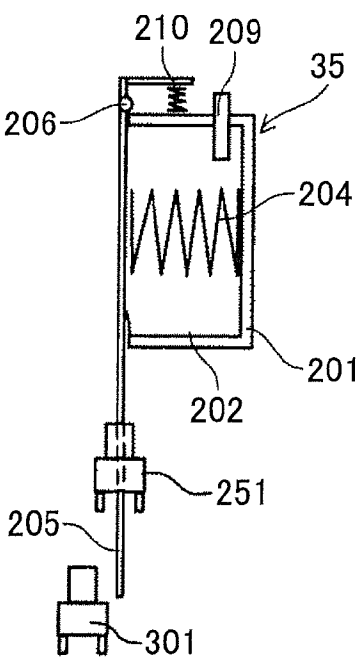
Figure 16C:
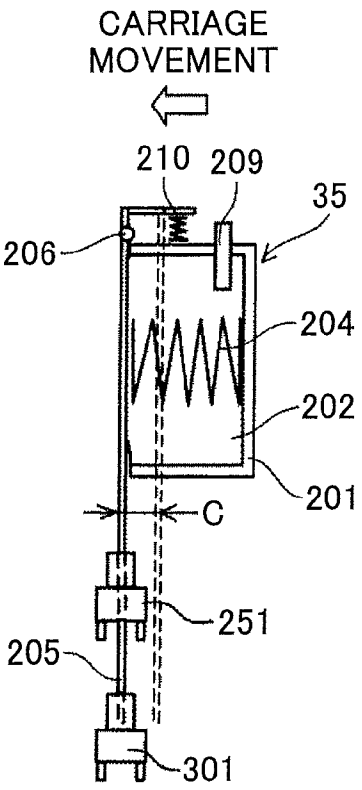

Next, a second embodiment of the present invention is described with reference to FIGS. 16A through 16C. FIGS. 16A through 16C are drawings illustrating the second embodiment.

Herein, as the method of detecting the differential supply amount corresponding to the displacement amount between the position of the displacement member 205 detected by the first sensor 251 and the position of the displacement member 205 detected by the second sensor 301, as illustrated in FIG. 16A, the carriage 33 is moved so that the second sensor 301 can detect the displacement member 205. Then, as illustrated in FIG. 16B, in a state where the displacement member 205 is at the position corresponding to the air opened position and the filling full tank position, the fluid feed pump 241 is reversibly driven to suction ink until the first sensor 251 detects the displacement member 205. Then, the fluid feed pump 241 is stopped, as illustrated in FIG. 16C, in a state where the first sensor 251 detects the displacement member 205, the carriage 33 is moved until the second sensor 301 detects the displacement member 205. By measuring the distance of the movement using the linear encoder 90, the displacement amount of the flexible film 203 or the displacement member 205 from the air opened position or the filling full tank detecting position until the first sensor 251 detects the displacement member 205 is detected and the differential supply amount corresponding to the displacement amount is measured.

Figure 17:
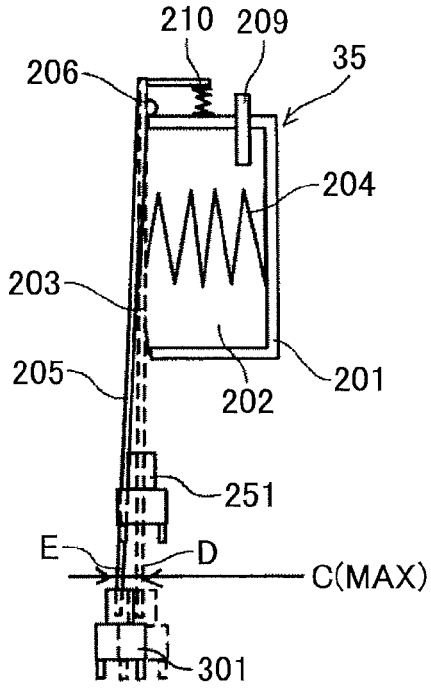
FIG. 17 is a schematic view of a sub tank according to a third embodiment of the present invention.
Figure 18:
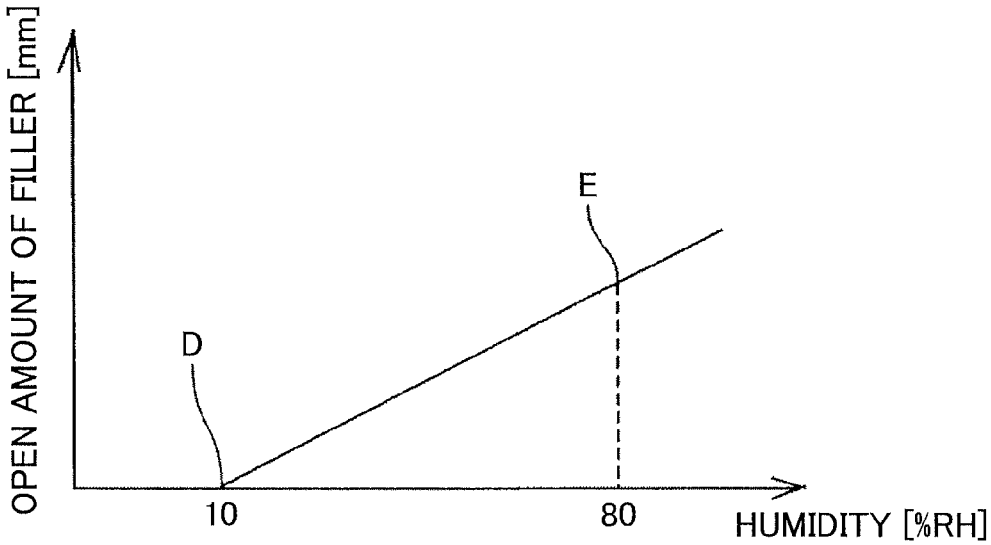
FIG. 18 is a graph illustrating a relationship between a humidity value and a displacement amount of a displacement member.
Figure 19:
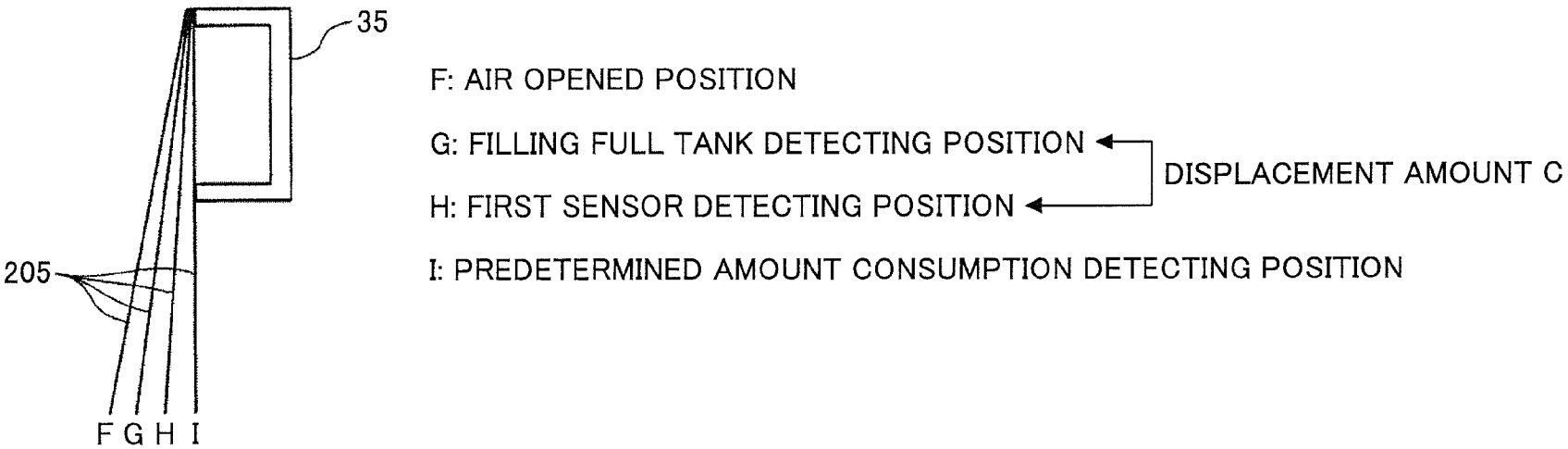
FIG. 19 is a drawing illustrating the third embodiment of the present invention.

Next, a third embodiment of the present invention is described with reference to FIG. 17 through FIG. 19. FIG. 17 schematically illustrates a sub tank according to a third embodiment of the present invention. FIG. 18 is a graph illustrating an exemplary relationship between a humidity value and the displacement amount of a displacement member. FIG. 19 illustrates the third embodiment of the present invention. The flexible film 203 of the sub tank 35 may be displaced based on the surrounding environments of the image forming apparatus. Specifically, the flexible film 203 may be extended or compressed as an environment such as humidity changes. Therefore, as illustrated in FIGS. 16 and 17, the filling full tank position of the displacement member 205 at the low humidity 10% RH is set to a position D. Then, humidity is increased up to the high humidity 80%RH, the flexible film 203 is expanded, and accordingly the displacement member 205 is displaced to a position E (see FIG. 17).

Namely, due to the change of the surrounding environment, the air opened position F and the filling full tank position G of the displacement member 205 illustrated in FIG. 18 may change.

Therefore, the first sensor 251 is installed at a predetermined detecting position corresponding to a state where the flexible film 203 is most compressed under a predetermined environment. For example, the first sensor 251 is installed in a manner such that the first sensor 251 at the filling full tank position D can detect the displacement member 205 even under the minimum humidity environment.

By doing in this way, in a case where the first sensor 251 is installed in a manner such that the first sensor 251 at the filling full tank position D can detect the displacement member 205 under the minimum humidity environment, when the displacement member 205 is displaced to the filling full tank position D due to ink supply, the first sensor 251 detects the displacement member 205 and the second sensor 301 detects the displacement member 205 as well (displacement amount C=0). On the other hand, in a case where the first sensor 251 is installed in a manner such that the first sensor 251 at the filling full tank position E can detect the displacement member 205 under a high humidity environment, the first sensor 251 detects the displacement member 205 first and the second sensor 301 detects the displacement member 205.

In this case, by storing the displacement amount C (max) from the detection by the first sensor 251 until the detection by the second sensor 301, it may become possible to set an appropriate filling full tank position corresponding to the environments by supplying ink corresponding to the displacement amount C from the detecting position of the first sensor 251 even during printing operation.

Further, in a case where the displacement amount C is to be measured (detected) again, for example, it is determined whether a difference between the humidity when the displacement amount C was stored and the current humidity is equal to or greater than a predetermined value by using a humidity detection unit detecting the surrounding environment. Then, when determining that the difference in the humidity is equal to or greater than the predetermined value, the displacement amount C is measured and stored.

Further, in a case where the flexible film 203 is expanded or compressed due to change of the environmental temperature, the first sensor 251 may be installed at a position corresponding to a state where the flexible film 203 is most compressed under a predetermined environmental temperature. In this case, it may be determined whether a difference between the temperature when the displacement amount C was stored and the current temperature is equal to or greater than a predetermined value by using a temperature detection unit detecting the surrounding environment. Then, when determining that the difference in the temperature is equal to or greater than the predetermined value, the displacement amount C is measured and stored.

Further, due to the influence caused by sudden environment change during printing, or unpredictable errors such as a detection error more than expected in the detection of ink discharge amount and a detection error more than expected in the detection of fluid feed amount by the fluid feed pump 241, the detection position H of the first sensor 251 and a predetermined amount consumption detecting position I based on the discharge amount may cause changes in their positions. In this case, when ink is supplied to the filling full tank position after the predetermined amount consumption detection, ink may be continuously supplied without detecting the displacement member 205 by the first sensor 251. As a result, ink may be excessively stored in the sub tank 35, which may cause damage to the sub tank 35 or ink leakage.

To avoid the problem, in a case where the predetermined amount consumption detecting position I is detected by the discharge amount detection, when the displacement member 205 has not passed at and detected by the first sensor 251, ink is discharged until the first sensor 251 detects the displacement member 205. Then, after first, sensor 251 detects the displacement member 205, ink corresponding to the displacement amount C is supplied.

In this case, when it is detected that those operations are repeated at a predetermined number of times, the printing operation is stopped, so that a status is set to the filling full tank position again and the displacement amount C is detected again.

Figure 20:
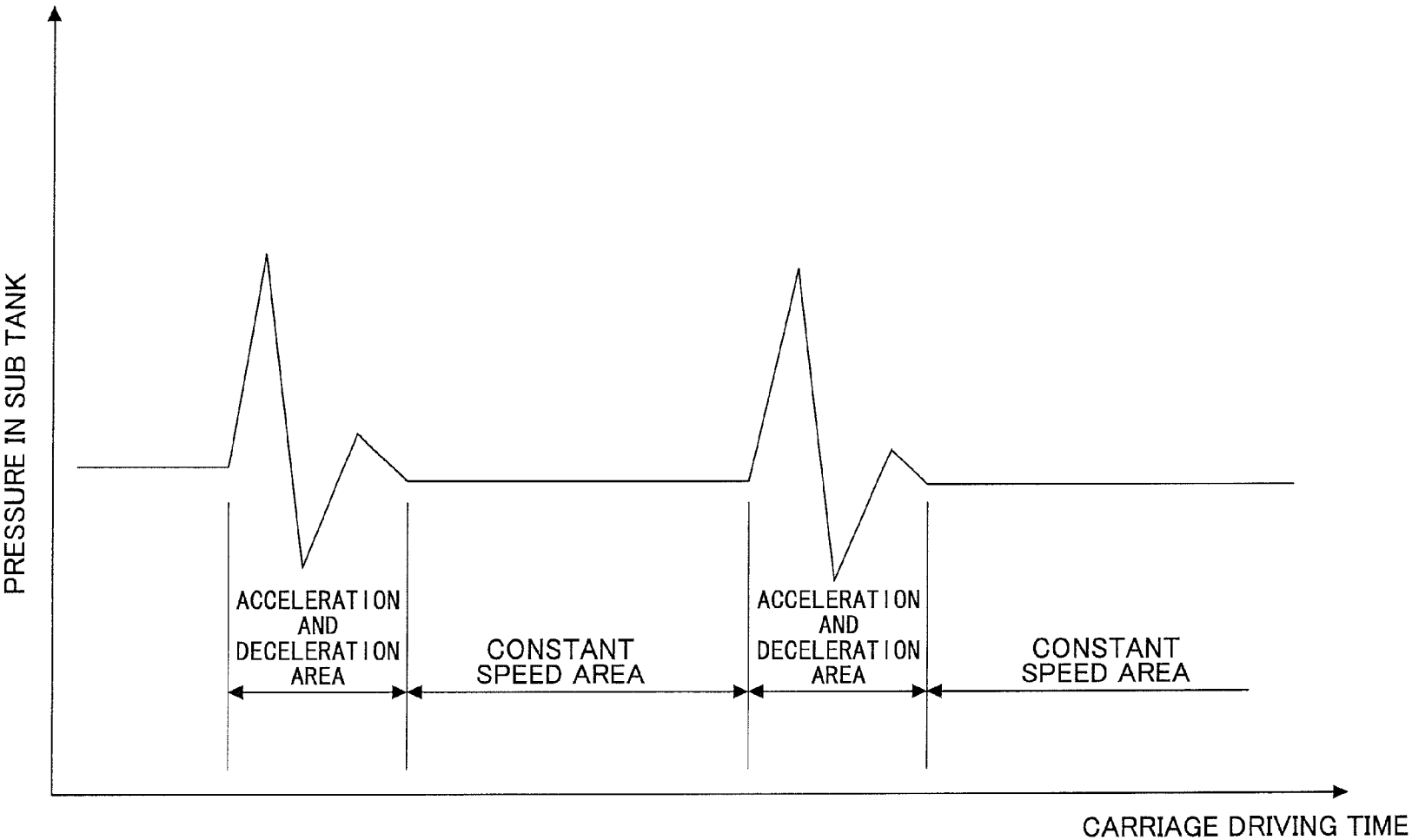
FIG. 20 is a graph illustrating a pressure fluctuation in the sub tank during scanning of a carriage according to a fourth embodiment of the present invention.
Figure 21B:
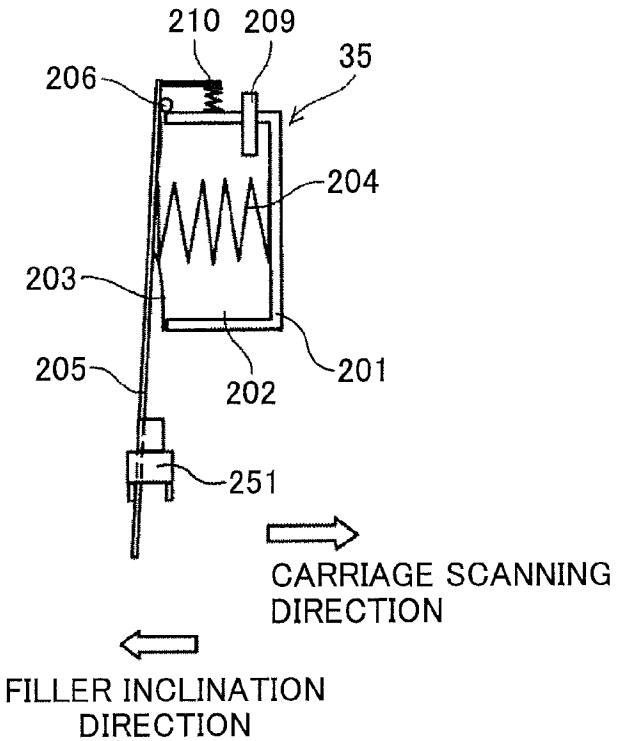
FIGS. 21A and 21B are drawings illustrating a carriage scanning direction and an inclination of the displacement member according to the fourth embodiment of the present invention.
Figure 21A:
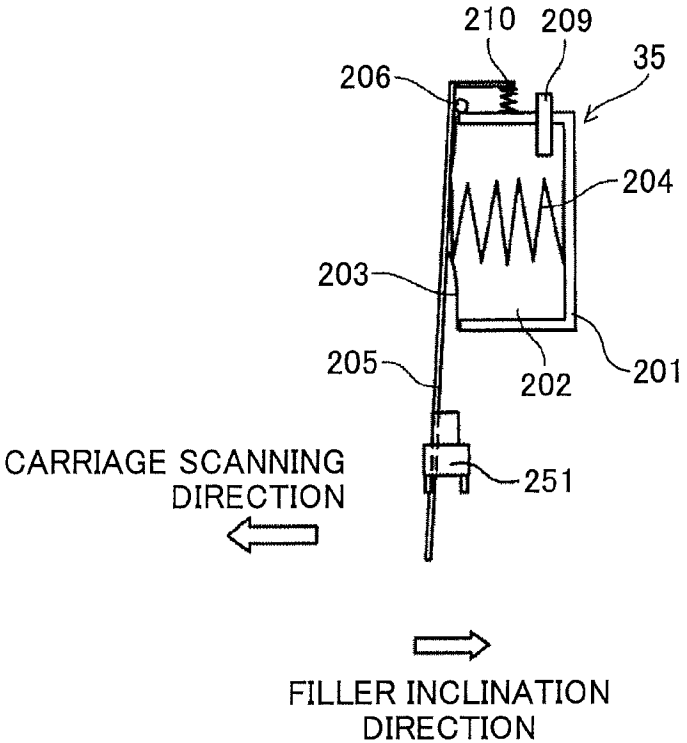

Next, a fourth embodiment of the present invention is described with reference to FIG. 20 and FIGS. 21A and 21B. FIG. 20 is a graph illustrating a pressure fluctuation in the sub tank 35 during scanning of a carriage. FIGS. 21A and 21B are drawings illustrating a carriage scanning direction and an inclination of the displacement member 205.

First, as illustrated in FIG. 20, the pressure in the sub tank 35 may be fluctuated when carriage 33 moves back and forth because the moving speed of the carriage is reduced and increased whenever the carriage 33 changes its moving directions from forward to backward and from backward to forward.

Under such a state, when ink is supplied from the fluid feed pump 241 to the sub tank 35, an ink supply pressure and a carriage drive pressure may be applied to the sub tank 35 at the same time, which may affect the stability of the negative pressure in the sub tank 35.

Therefore, when ink is to be supplied to the sub tank 35 during the scanning of the carriage 33, it is preferable that ink is supplied while the carriage scans at a constant speed, which causes less carriage drive pressure. When ink is supplied during the constant speed, the behavior of the displacement member 205 is less than that during the acceleration or deceleration period. Therefore, when ink is supplied during the constant speed, erroneous detection by the first sensor 251 may be avoided.

Further, depending on the scanning direction of the carriage 33, the behavior of the displacement member 205 that is in press-contact with the flexible film 203 of the sub tank 35 may change. Namely, as illustrated in FIGS. 21A and 20B, during the scanning of the carriage 33, the behavior of the displacement member 205 provided on the scanning side of the carriage 33 is small because the displacement member 205 is biased to the inclination direction against the flexible film 203 with which the displacement member 205 is in press-contact. On the other hand, the behavior of the displacement member 205 provided on a side opposite to the scanning side of the carriage 33 is great because the displacement member 205 is biased to the separation direction from the flexible film 203.

Therefore, when ink is to be supplied to the sub tank 35 during the scanning of the carriage, ink is supplied to the sub tank 35 having the flexible film 203 (displacement member 205) disposed on the scanning direction side of the carriage 33. By doing in this way, it may become possible to supply ink while the negative pressure in the sub tank is stabilized even during the scanning operation.

Figure 22:
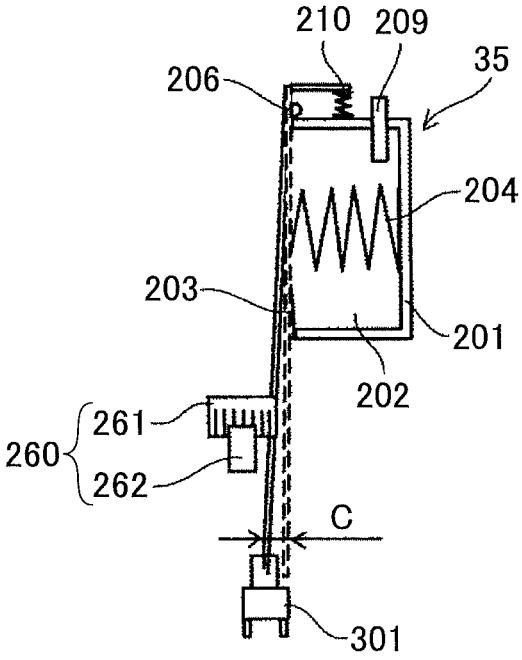
FIG. 22 is a schematic view illustrating a sub tank according to a fifth embodiment of the present invention.

Next, a fifth embodiment of the present invention is described with reference to FIG. 22. FIG. 22 schematically illustrates a sub tank according to the fifth embodiment of the present invention.

Herein, a linear encoder 260 is used. As the first sensor 251, an encoder scale 261 is provided on the displacement member 205. On the other hand, an encoder sensor 262 for reading the encoder scale 261 is provided on the carriage side.

By having this configuration, it may become possible to directly measure the distance (displacement amount) of the displacement member 205 until the second sensor 301 detects the displacement member 205 and acquire the displacement amount C of the displacement of the flexible film 203 of the sub tank 35, thereby enabling detecting the ink capacity (amount) of the sub tank 35.

The control (processes) of the ink supply operations to the sub tank described above may be executed by a computer based on a program stored in the ROM 502. The program may be installed in the image forming apparatus after being downloaded on the information processing apparatus (host 600) side. Further, by combining an image forming apparatus according to an embodiment of the present invention, an information processing apparatus or image forming apparatus, and an information processing apparatus having a program for performing a process according to an embodiment of the present invention, an image forming system may be provided.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teachings herein set forth.

The present application is based on and claims the benefit of priority of Japanese Patent Application No. 2010-056534, filed on Mar. 12, 2010, the entire contents of which are hereby incorporated herein by reference.

The intention claimed is:

1. An image forming apparatus comprising:

an apparatus main body;

a recording head discharging liquid droplets;

a sub tank containing liquid to be supplied to the recording head;

a carriage on which the recording head and the sub tank are mounted;

a main tank containing liquid to be supplied to the sub tank; and a fluid feeding unit performing fluid supply from the main tank to the sub tank, wherein the sub tank includes a displacement member to be displaced depending on a remaining amount in the sub tank, the carriage includes a first detecting unit detecting that the displacement member is at a predetermined first position, the apparatus main body includes a second detecting unit detecting that the displacement member is at a predetermined second position, the remaining amount at the predetermined first position is less than the remaining amount at the predetermined second position, the image forming apparatus further includes a control section that detects and stores a differential supply amount corresponding to a displacement amount of the displacement member, the displacement amount corresponding to a difference between a position detected by the first detecting unit and a position detected by the second detecting unit, and the control section performs control to supply the differential supply amount of liquid to the sub tank after the first detecting unit detects the displacement member n a case here liquid is supplied from the main tank to the sub tank without using the second detecting unit.

2. The image forming apparatus according to claim 1, wherein the control of the supply of the differential supply amount is performed based on a driving time period of the fluid feeding unit, the driving time period being required to move the displacement member from the first predetermined position to the second predetermined position.

3. The image forming apparatus according to claim 1, wherein the control of the supply of the differential supply amount is performed based on a number of rotations of the fluid feeding unit, the number of rotations being required to move the displacement member from the first predetermined position to the second predetermined position.

4. The image forming apparatus according to claim 1, wherein the control of the supply of the differential supply amount is performed based on a detected displacement amount of the displacement member.

5. The image forming apparatus according to claim 1, further comprising:

a detecting unit detecting at least n environmental temperature and an environmental humidity of the image forming apparatus, wherein when determining that a difference between a result detected by the detecting unit and a predetermined threshold value is equal to or greater than a predetermined value, the differential supply amount is detected.

6. The image forming apparatus according to claim 1, wherein when at least one of the environmental temperature and the environmental humidity is a predetermined value, the predetermined first position refers to a position where the displacement amount of the displacement member is within a predetermined range, the displacement amount corresponding to a difference between the first predetermined position and the second predetermined position.

7. The image forming apparatus according to claim 1, wherein a case where liquid is supplied from the main tank to the sub tank without using the second detecting unit corresponds to a case where a discharge amount discharged from the recording head exceeds a predetermined amount.

8. The image forming apparatus according to claim 1, wherein in a case where the first detecting unit does not detect the displacement member even when a discharge amount discharged from the recording head exceeds a predetermined amount, control is performed to discharge liquid until the first detecting unit detects the displacement member.

9. The image forming apparatus according to claim 8, wherein when a number of times that a control has been performed to discharge liquid until the second detecting unit detects the displacement member exceeds a predetermined number of times, the discharge from the recording head is stopped.

10. The image forming apparatus according to claim 1, wherein during scanning of the carriage, while a scanning direction of the carriage corresponds to a direction towards an anterior side of a scanning direction of the displacement member of the sub tank, ink is supplied to the sub tank.

11. The image forming apparatus according to claim 1, wherein when the differential supply amount is detected, the displacement member is displaced by suctioning fluid from the sub tank to the main tank until the first detecting unit detects the displacement member.

* * * * *